United States Patent [19]

Church

[11] 4,315,828

[45] * Feb. 16, 1982

[54] WATER BASED WINDOW GLASS AND CHROME CLEANER COMPOSITION

[75] Inventor: Peter K. Church, Cascade, Colo.

[73] Assignees: Max L. Wymore; Leisure Products Corporation, both of Colorado Springs, Colo. ; a part interest to each

[ * ] Notice: The portion of the term of this patent subsequent to Jul. 22, 1997, has been disclaimed.

[21] Appl. No.: 119,861

[22] Filed: Feb. 8, 1980

Related U.S. Application Data

[63] Continuation-in-part of Ser. No. 885,311, Mar. 10, 1978, Pat. No. 4,213,873.

[51] Int. Cl.[3] ..... C11D 3/43; C11D 1/72

[52] U.S. Cl. ..... 252/153; 252/170; 252/173; 252/174.14; 252/174.21; 252/DIG. 10

[58] Field of Search ..... 252/70, 135, 140, 153, 252/162, 170, 173, 523, 541, 73, 174.21, 174.22, DIG. 10, 174.14; 106/13

[56] References Cited

U.S. PATENT DOCUMENTS

| | | | |
|---|---|---|---|
| 2,710,843 | 6/1955 | Stebleton | 252/158 |
| 3,342,740 | 9/1967 | Kazmierczak et al. | 252/170 X |
| 3,463,735 | 8/1969 | Stonebraker et al. | 252/162 X |
| 3,839,234 | 10/1974 | Roscoe | 252/DIG. 10 X |
| 3,882,038 | 5/1975 | Clayton et al. | 252/174.21 X |
| 4,213,873 | 7/1980 | Church | 252/173 X |

*Primary Examiner*—P. E. Willis, Jr.
*Attorney, Agent, or Firm*—Max L. Wymore

[57] ABSTRACT

A water based cleaning composition including a major portion of water, a minor portion of a cleaning agent such as ammonium hydroxide or a lower alcohol such as isopropanal and a small portion of a polyethylene and alkoxy polyethylene glycol of high molecular weight and triethylene glycol which not only acts as a lubricant but has a preferential affinity for glass and the like as compared with oil, grease, dirt and/or lubricity component such as ammonium bicarbonate or ammonium carbonate.

1 Claim, No Drawings

WATER BASED WINDOW GLASS AND CHROME CLEANER COMPOSITION

BACKGROUND

This Application is a Continuation-in-Part of Applicant's Copending U.S. Application Ser. No. 885,311 filed March 10, 1978, now Patent No. 4,213,873.

This invention is directed to new and novel highly efficient liquid compounds for cleaning of glass and the like and the method for making same. While principally aimed at the cleaning of windows, mirrors and other objects made of glass, these compounds have been found to be equally useful for the cleaning of polished chromium, stainless steel, porcelain enamels, ceramic, plastics and many other such items that may need to be cleaned of oil, grease, dirt and other contaminants in a similar manner.

Typical liquid type window cleaners presently on the market utilize a water based system, usually combined with solvents such as isopropyl alcohol, butyl cellosolve (2-butoxy ethanol) and the like, to which is added a highly efficient surfactant.

In addition, most such formulations also contain a percentage of ammonia, plus perhaps a phosphate of other such substance, to further enhance grease cutting action.

Special care is taken in the compounding of such formulations to achieve a good balance between evaporation rate of the cleaner applied to the glass and absorption rate into the toweling. Any solids included, such as phosphates, must be limited in amount so as not to leave an objectionable residue on the glass surface. Of particular importance is the achievement of good lubricity so as to reduce the physical effort required by the user during the wiping and drying process as much as possible.

U.S. Pat. No. 3,463,735 issued to Stonebraker and Wise, Aug. 26, 1969, covers such a glass cleaning composition and appears to be typical, with minor variations, of most of the window cleaning liquids presently available on the market going under such trade names as WINDEX, GLASS PLUS, EASY-OFF, AJAX window cleaner, and the like.

The basic principle of operation of these prior art window cleaners is to thoroughly emulsify the oil and grease with the water based cleaning solution, along with loosening any dirt and other contamination. This oil, grease and dirt laden solution is then hopefully wiped from the glass by means of the paper towel or cloth used to wipe the surface dry.

In actuality, it is extremely difficult to thoroughly clean the glass in this manner. Oil and grease, in particular, are difficult to transfer completely to the toweling and at least a portion of the contamination invariably becomes redistributed on the glass as a re-adhering film. The result is the oil and grease streaked window or mirror that almost everyone has experienced with these liquid type cleaners after thinking that a thorough cleaning job had been done.

SUMMARY OF THE INVENTION

The present invention is based on an entirely different principle. It has been found that one of several organic compounds, selected from a closely related group of compounds, can be added to a water based cleaning solution and provide a pronounced affinity for glass and many other surfaces, while at the same time having a definite non-affinity for oil and grease. The cleaning solution may also contain suitable amounts of alcohol, ammonia, surfactants, etc.

More specifically, I have found that a very small percentage of a polyethylene glycol or methoxypolyethylene glycol (condensation polymers of ethylene glycol) introduced into a suitable liquid cleaning solution, and applied for example, to a smooth glass surface, will produce a very thin, visually transparent, well adhering and very smooth and slick coating on the surface of the glass following the wiping and drying operation with paper, cloth, or other type of absorbent toweling. Furthermore, the contaminants loosened by the cleaning liquid, including emulsified oil and grease, have been found to be effectively repelled by the coated glass and transferred almost entirely to the toweling, leaving the glass in an exceptionally clean and streak-free condition.

It has also been found that the thin polyethylene or methoxypolyethylene glycol coating that is formed on the glass surface as a result of the cleaning operation, can effectively repel many airborne organic contaminants such as oil and plasticizer fumes. For example, its use has been found to keep the inside windows in an automobile visually "cleaner" for considerably longer periods of time than any of the several prior art liquid window cleaning solutions that have been run in direct comparison tests.

The molecular weight range for the polyethylene or methoxypolyethylene glycols as used in this invention can be varied considerably. To date, I have used successfully such compounds ranging from 400 to 20,000 in molecular weight and it is believed that even higher molecular weight ranges would be useful, if available.

A typical long chain polyethylene glycol molecule can be represented in the following manner. It can be seen that it contains a large number of oxygen atoms compared with the number of carbon atoms for an organic compound. Also, unlike compounds such as sugars, it contains very few OH groups. The following is representative of a 6,000 molecular weight polyethylene glycol, n ~130.

$$HOCH_2(CH_2OCH_2)_nCH_2OH \qquad \text{Formula (1)}$$

The general formula for these compounds is represented by $ROCH_2(CH_2OCH_2)_nCH_2OR$, wherein R is hydrogen or alkyl.

Methoxypolyethylene glycol can be represented as above except that the HO group at each end is replaced with an $H_3C—O—$ group.

The non-bonded oxygen electron pairs are apparently strongly attracted to the cations present in the glass or other surface to which an attachment seems to occur.

It is believed that the criteria for the selection of an effective polyethylene glycol like compound as used in this invention can be summarized as follows:

(a) Must have a large number of oxygen atoms per molecule compared to the number of carbon atoms.

(b) Must have a very limited number of hydroxy (OH) groups per molecule.

(c) Must be water soluble.

(d) Must have no chemical reaction with water.

While there may be a few other compounds that satisfy the above criteria, such as polyester or polyamide made from a low molecular weight monomer, the polyethylene and methoxypolyethylene glycols are undoubtedly the most stable, most water soluble, readily available, lowest cost and harmless compounds that have been found in this limited category.

It is not known whether the polyethylene or methoxypolyethylene glycol layer is formed immediately upon application of the relatively dilute solution of the liquid cleaner to the glass or whether it forms its attachment and oil and grease repelling film when it is nearly dry or perhaps even completely dry. In any event, it has been found to cause extremely efficient transfer of the oil or grease into the paper towel or cloth without leaving streaks on the glass. If a streak is inadvertently left on the glass by letting the solution dry before wiping thoroughly, it can still be easily removed by wiping lightly with a dry cloth or paper towel. This indicates that the polyethylene or methoxypolyethylene glycol layer has formed an attachment to the glass underneath the oil or grease contamination layer.

It should be noted that the weight amounts listed in the various tables of this application for polyethylene glycol and methoxypolyethylene glycol may also include an amount of added water. The molecular weight grades of these materials that are solids at room temperature were premixed with water for ease of handling and to assure rapid blending with the liquid cleaner formulations. The amount of water included, if any, in each instance is set forth by the notes referred to in each table. In summary, the weight values listed for polyethylene glycol 400 and methoxypolyethylene glycol 550 are correct as listed in the tables and include no water. The weights given for polyethylene glycol 1,540, 4,000 and 6,000 and for methoxypolyethylene glycol 2,000 and 5,000 include 1 part water and 1 part glycol by weight. The weight for the polyethylene glycol 20,000 linear and polyethylene glycol compound 20M includes 2 parts water to 1 part of the glycol by weight. The weights for these materials referenced in the claims are without added water. The notes referred to in each table are set forth for the first time in Table I.

Examples of some basic liquid window and glass cleaning formulations according to the invention have been presented in Table I to provide a better overall idea of the invention.

TABLE I

BASIC FORMULATION EXAMPLES

| # | Water & Alcohol | Amount (grams) | Grease Cutting Aids | Amount (grams) | Organic Lubricant Aids | Amount (grams) | Surfactant | Amount (grams) | Polyethylene or Methoxypolyethylene Glycol | Amount (grams) |
|---|---|---|---|---|---|---|---|---|---|---|
| 1 | $H_2O$ | 100 | $NH_4OH^{(o)}$ | 0.312 | — | — | — | — | PEG-6K$^{(h)}$ | 0.10 |
| 2 | $H_2O$ | 80 | — | — | — | — | — | — | PEG-6K$^{(h)}$ | 0.08 |
| | Isopropanol | 15.70 | | | | | | | | |
| 3 | $H_2O$ | 90.80 | $NH_4OH^{(o)}$ | 0.364 | — | — | — | — | MPEG-5K$^{(f)}$ | 0.20 |
| | Isopropanol | 2.35 | | | | | | | | |
| | 1-propanol | 4.05 | | | | | | | | |
| 4 | $H_2O$ | 88.65 | $NH_4OH^{(o)}$ | 0.260 | — | — | NEKAL BA-77$^{(b)}$ | 0.011 | MPEG-2K$^{(n)}$ | 0.182 |
| | Isopropanol | 3.15 | | | | | | | | |
| | 1-propanol | 4.90 | | | | | | | | |
| 5 | $H_2O$ | 90.80 | $KBO_2 \cdot \times H_2O$ | 0.10 | 2,3-butanediol | 0.039 | NEKAL BX-78$^{(c)}$ | 0.007 | PEGC-20M$^{(i)}$ | 0.26 |
| | Isopropanol | 2.35 | $NH_4HCO_3$ | 0.10 | | | | | | |
| | 1-propanol | 4.05 | | | | | | | | |
| 6 | $H_2O$ | 86.75 | $NH_4OH^{(p)}$ | 0.156 | 2,3-butanediol | 0.039 | NEKAL BX-78$^{(c)}$ | 0.007 | PEGC-20M$^{(i)}$ | 0.26 |
| | Isopropanol | 9.45 | | | | | | | | |
| | 1-propanol | 0.247 | | | | | | | | |

(b)NEKAL surfactant, sodium alkylnaphthalene sulfonate, Mfg, by GAF Corporation, New York, N.Y.
(c)NEKAL surfactant, sodium alkylnaphthalene sulfonate, Mfg. by GAF Corporation, New York, N.Y.
(f)Carbowax methoxypolyethylene glycol, 5000 molecular weight, Mfg. by Union Carbide Corporation, New York, N.Y. Amount shown includes MPEG-5000 + $H_2O$ 1:1 by weight
(h)Carbowax polyethylene glycol, 6000–7500 molecular weight, Mfg. by Union Carbide Corporation, New York, N.Y. Amount shown includes PEG-6000 + $H_2O$ 1:1 by weight
(i)Polyethylene Glycol Compound-20M, approx. molecular weight of 15,000, Mfg. by Union Carbide Corporation, New York, N.Y. Amount shown includes PEGC-20M + $H_2O$ 1:2 by weight
(n)Carbowax methoxypolyethylene glycol, 1900 molecular weight, Mfg. by Union Carbide Corporation, New York, N.Y. Amount shown includes MPEG-2000 + $H_2O$ 1:1 by weight
(o)28% $NH_3$
(p)30% $NH_3$ Formulation 1 shows a mixture of water, polyethylene glycol and ammonia. While admittedly a very simple composition, such a cleaning solution is found useful for application to windows with a sponge or similar means and then removing the liquid with a squeegee. Other grease cutting additives such as phosphates, borates, glyconates, citrates, etc., could of course be included with or without the ammonia. The example does, however, illustrate the very small percentage of polyethylene glycol that can be used in such applications.

The remaining formulations in Table I show cleaning solutions intended to be applied to the glass or other smooth surface by spray or similar means and then wiping from the surface by absorbent toweling. The various additives in these examples are included for such purposes as improved grease cutting, adjustment of absorbency rate into toweling, maximizing lubricity during the wiping dry operation and varying the evaporation rate of the cleaner.

The alcohol used in formulations 2, 3, 4, 5 and 6 of Table I, aids in several ways: (1) it substantially improves the lubricity during the wiping operation with the toweling; (2) it helps dissolve and emulsify oil and grease films that may be present on the glass or other surface; (3) it speeds evaporation of the cleaning liquid; and, (4) increases the wicking rate into the toweling due to its inherent wetting properties.

The ammonia included in most of these formulations (1, 2, 3, 4 and 6) helps to saponify any contaminating oils and greases. It has the special advantage that it evaporates completely, leaving no residue on the glass or other surface being cleaned.

Formulations 3, 4, 5 and 6 have a combination of alcohols. These have been found to provide greater lubricity (less drag) during the wiping dry operation than either alcohol alone.

Formulations 4, 5 and 6 all contain a surfactant or surface active agent. In these particular examples, a sodium alkanapthylene sulfonate. This has been added to the solution primarily for its wetting ability and increasing the absorbency rate of the liquid into the toweling. The use of surfactants must be very carefully controlled so as not to effect the oil and grease repelling properties of the polyethylene glycol and methoxypolyethylene glycol additive.

Formulation 5 contains no ammonia but instead makes use of small amounts of soluble solids as grease cutting aids (in this instance potassium metaborate and ammonium bicarbonate). The latter also improves the lubricity to a marked extent and in this respect serves a dual purpose. Small amounts of phosphates, silicates, citrates, etc., can also make effective additives.

Formulation 6 includes 2,3-butanediol as an organic lubricant additive. When used in the correct proportions with the alcohols, such higher boiling point organics can often markedly improve the ease of wiping during the drying operation and make a more frictionless transition between the nearly dry to the completely dry stage.

In accordance with the overall invention, all of these formulations include the polyethylene glycol and/or methoxypolyethylene glycol, as an oil and grease repelling additive. The higher molecular weight grades are hard wax type materials when free of water and other solvents. These grades were selected in these examples so as to impart a very smooth slick surface by the time the cleaning solution is wiped to the completely dry stage.

For more detailed discussions, along with examples of representative formulations and comparative test results, reference is made to the following:

The low boiling point monohydroxy alcohols are commonly used in most all commercially available liquid window and glass cleaning solutions now on the market. The alcohol aids in dissolving or emulsifying oil and grease, can noticeably improve overall lubricity of the cleaner and increase evaporation rates and wicking rates into absorbent toweling. Higher boiling point organic solvents are often also added along with the alcohol to modify some or all of the effects just listed.

These alcohols and other solvents are normally selected to have boiling points that fall within the range of 60° C.–250° C. The higher boiling point limitation is to assure that evaporation is more or less complete by the time the surface has been wiped to a "dry" condition.

U.S. patents covering various window cleaner products, e.g., U.S. Pat. No. 3,839,234 (Oct. 1, 1974) to Roscoe; U.S. Pat. No. 2,993,866 (July 25, 1961) to Vaughn, et al; U.S. Pat. No. 3,679,609 (July 25, 1972) to Castner; U.S. Pat. No. 3,696,043 (Oct. 3, 1972) to Labarge et al; U.S. Pat. No. 2,386,106 (Oct. 2, 1945) to Gangloff, and the patent mentioned earlier, U.S. Pat. No. 3,463,735 (Aug. 26, 1969) to Stonebraker and Wise, are cases in point where one or more alcohols or organic solvents are included in a liquid window or glass cleaner formulation.

The addition of one or more of the low molecular weight, low boiling point monohydroxy alcohols, including methanol, ethanol, isopropanol and 1-propanol, have been found to be advantageous for use in the present invention.

All four of these alcohols are helpful in achieving desirable evaporation rates, wicking rates into the toweling and aid in loosening and emulsifying oil, grease and other contaminating films on the surface being cleaned.

The major difference between the alcohols for use in the various formulations of this invention, has been found to be their effect on overall lubricity. By this is meant the ease with which the surface being cleaned can be wiped with suitable absorbent toweling from the initial wet stage, through the intermediate stages to the final completely dry stage.

In this respect, the isopropanol and 1-propanol are found to provide the highest degree of lubricity when used individually and in sufficient amount. The methanol provided the least lubricity improvement and the ethanol assumes an intermediate position.

These comparisons, using ~10% alcohol to water content by weight are shown in the data of Table II. The overall formulation used in this test was fairly basic in nature. Although not shown here, similar tests with other formulations (such as substituting polyethylene glycol for the methoxypolyethylene glycol and omitting the 2,3-butanediol) and using different alcohol percentages, have shown the same basic lubricity results for the four alcohols in question.

TABLE II

EFFECT OF TYPE OF ALCOHOL ADDITIVE ON OVERALL LUBRICITY

BASIC FORMULATION: 86.75g $H_2O$
— Alcohol - see below
0.208g $NH_4OH^{(p)}$
0.026g 2,3-butanediol
0.018g surfactant, BA-77[b]
0.20g MPEG-5K[f]
TEST SURFACE: 24" × 18" Plate Glass

| # | Alcohol | Amount (grams) | Boiling Point (PC) | Lubricity - (Measured in terms of comparative drag while wiping glass surface from wet to dry stage with paper towel) |
|---|---|---|---|---|
| BN-31 | Methanol | 9.5 | 64.5 | More drag nearly dry than BN-32 ~ BN-32 & BN-33 when dry |
| BN-32 | Ethanol | 9.55 | 78.5 | A little more drag than BN-33 nearly dry ~ BN-33 dry |
| BN-33 | Isopropanol | 9.4 | 82.3 | Very low drag nearly dry |
| BN-34 | 1-propanol | 9.5 | 97.2 | Slightly more drag nearly dry than BN-33, but also slightly less drag nearly dry than BN-32. Very slightly less drag than BN-33 when dry |

NOTES - See Table I

Alcohols such as the butanols and pentanols have not been considered because of their inherent toxicity, eye irritant properties, or other such disadvantages. Even though included in Table II, the use of ethanol is seriously questioned from a practical standpoint due to government regulations that make its use in a product of this type difficult and somewhat costly.

While methanol provides the poorest lubricity improvement of the alcohols tested, it can still be a viable additive in specialized cases. An example would be for use in low freezing point solutions such as for automatic, automobile windshield washers, etc., where other factors may outweigh that of achieving maximum lubricity.

An interesting finding was that a mixture of isopropanol and 1-propanol can result in a considerable lubricity improvement over that of either alcohol alone. Furthermore, it has been found that there are two different proportions that achieve maximum lubricity, one favoring the 1-propanol as the alcohol having the largest percentage involved and the other favoring the isopropanol. These two systems are shown in Tables III and IV, respectively.

TABLE III

1-PROPANOL, ISOPROPANOL MIXTURES FOR MAXIMIZING LUBRICITY, WITH 1-PROPANOL PREDOMINATING

BASIC FORMULATION: 83.75g $H_2O$
— Alcohol - See below
0.364g $NH_4OH^{(o)}$
0.026g 2,3, Butanediol
0.011g surfactant, BA-77[b]
0.20g MPEG-5K[f]
TEST SURFACE: 24" × 18" Plate Glass

| # | Alcohol | Amount (grams) | Ratio 1-Propanol: Isopropanol | Lubricity (Comparative drag while wiping surface from wet to dry stage with paper towel) |
|---|---|---|---|---|
| CJ-1 | Isopropanol | 11.75 | 0% | Noticeably more drag nearly dry than CJ-4 and also more completely dry |
| | Isopropanol | 9.45 | | Slightly lower drag nearly dry than CJ-6 but not quite as smooth completely dry |
| CJ-2 | | | 0.2:1 | Note quite as much drag when nearly dry or dry as CJ-1 |
| | 1-propanol | 2.20 | | |
| | Isopropanol | 7.15 | | |
| CJ-3 | | | 0.7:1 | Less drag nearly dry and dry than CJ-2 |
| | 1-propanol | 4.80 | | Slightly more drag nearly dry and dry than CJ-7 |
| | Isopropanol | 5.45 | | |
| CJ-7 | | | 1.2:1 | Very slightly more drag nearly dry and dry than CJ-4 |
| | 1-propanol | 6.50 | | |
| | Isopropanol | 4.61 | | |
| CJ-4 | | | 1.6:1 | Excellent - Least drag wet to completely dry of any formulation in test |
| | 1-propanol | 7.45 | | |
| | Isopropanol | 3.90 | | |
| CJ-8 | | | 2.1:1 | ~CJ-7 |
| | 1-propanol | 8.15 | | |
| | Isopropanol | 2.30 | | |
| CJ-5 | | | 4.3:1 | Slightly more drag nearly dry and dry than CJ-8 |
| | 1-propanol | 9.80 | | Not quite as much drag as CJ-6 |
| | | | | Slightly more drag nearly dry and dry than CJ-5 |
| CJ-6 | 1-propanol | 12.1 | 100% | Slightly drag than CJ-1 nearly dry but very |
| | | | | Slightly less drag completely dry |

Notes - See Table I

TABLE IV

ISOPROPANOL, 1-PROPANOL MIXTURES FOR MAXIMIZING LUBRICITY WITH ISOPROPANOL PREDOMINATING

BASIC FORMULATION: 90.85g $H_2O$
— Alcohol - see below
0.104g $NH_4OH^{(p)}$
0.10g $K_4B_2O_7 \cdot 4H_2O$
0.10g $NH_4HCO_3$
0.018g Surfactant, BA-77[b]
0.20g MPEG-5K[f]

| # | Alcohol | Amount (gram) | Ratio Isopropanol: 1-Propanol | Lubricity (Comparative drag while wiping surface from wet to dry stage with paper towel) |
|---|---|---|---|---|
| JB-1 | Isopropanol | 6.10 | 100% | Considerably more drag nearly dry and a little more drag completely dry than JB-20 and JB-22 |
| | Isopropanol | 6.10 | | Noticeably less drag nearly dry and dry than JB-1 |
| JB-20A | | | 52.6:1 | Definitely more drag nearly dry than JB-20 and JB-22 |
| | 1-propanol | 0.116 | | but ~ same completely dry |
| | Isopropanol | 6.10 | | |
| JB-20 | | | 42.1:1 | Excellent - Same as JB-22 - Least drag wet to completely dry in test |
| | 1-propanol | 0.145 | | |
| | Isopropanol | 6.10 | | |
| JB-22 | | | 38.1:1 | Excellent - Same as JB-20 - Can't tell difference |

TABLE IV-continued

ISOPROPANOL, 1-PROPANOL MIXTURES FOR MAXIMIZING LUBRICITY WITH ISOPROPANOL PREDOMINATING

BASIC FORMULATION: 90.85g $H_2O$
— Alcohol - see below
0.104g $NH_4OH^{(p)}$
0.10g $K_4B_2O_7 . 4H_2O$
0.10g $NH_4HCO_3$
0.018g Surfactant, BA-77[b]
0.20g MPEG-5K[f]

| # | Alcohol | Amount (gram) | Ratio Isopropanol: 1-Propanol | Lubricity (Comparative drag while wiping surface from wet to dry stage with paper towel) |
|---|---|---|---|---|
| | Isopropanol | 0.160 | | |
| | Isopropanol | 6.10 | | |
| JB-21 | | | 35.1:1 | Very slightly more drag nearly dry than JB-20 and JB-22 |
| | 1-propanol | 0.174 | | But ~ same completely dry |
| | Isopropanol | 6.10 | | |
| JB-20B | | | 30.1:1 | Definitely more drag than JB-20 and JB-22 |
| | 1-propanol | 0.203 | | Nearly dry but ~ same completely dry |
| | Isopropanol | 2.35 | | A little more drag nearly dry than JB-20 and JB-22 |
| JB-2 | | | 0.6:1 | But ~ same completely dry. Definitely less drag |
| | 1-propanol | 4.05 | | than JB-20A and JB-20B nearly dry and ~ same completely dry |

Notes - See Table I

As can be noted from the data in Table III, maximum lubricity has been achieved in formulation CJ-4 with a 1-propanol to isopropanol ratio of the order of 1.6:1 by weight. Table IV, on the other hand, shows that maximum lubricity can also be achieved with a ratio of isopropanol to 1-propanol of ~40:1, as shown in formulations JB-20 and JB-22.

From a number of different tests, it has been found that the alcohol ratios as used in Table IV, formulation JB-20 and JB-22, where the isopropanol predominates, will provide slightly better lubricity than the proportions of formulation CJ-4 of Table III. Formulation JB-2 with the alcohol proportions maximized with the 1-propanol predominating has been included in Table IV to show lubricity comparisons between the two systems with an otherwise identical composition.

Tables V and VI show the effect of varying the total alcohol to water content from no alcohol to a maximum of ~20%. As can be seen from these tables, a minimum amount of alcohol below about 4% was found to cause a very noticeable increase in friction and an associated squeeking sound while wiping the glass surface with absorbent toweling from the wet to the partially dry stage.

TABLE V

EFFECT ON LUBRICITY OF VARYING WATER TO TOTAL ALCOHOL CONTENT USING 1-PROPANOL TO ISOPROPANOL RATIO OF ~ 1.6:1

BASIC FORMULATION: — $H_2O$ - see below
— Alcohol - see below
0.364g $NH_4OH^{(o)}$
0.026g 2,3-butanediol
0.011g Surfactant BA-77[b]
0.20g MPEG-5K[f]
TEST SURFACE: 24" × 18" Plate Glass

| # | $H_2O$ (grams) | Iso-propanol (grams) | 1-propanol (grams) | % Alcohol to $H_2O$ | Lubricity (Comparative drag while wiping with paper towel from wet to dry stage) |
|---|---|---|---|---|---|
| CM-8 | 78.60 | 6.30 | 9.80 | 20.1% | Excellent - Low drag wet to dry stage |
| CM-1 | 83.50 | 4.65 | 7.45 | 14.5% | ~CM-8 |
| CM-2 | 85.70 | 4.00 | 6.30 | 12.0% | ~CM-8 |
| CM-3 | 88.65 | 3.15 | 4.90 | 9.1% | ~CM-8 |
| CM-4 | 90.80 | 2.35 | 4.05 | 7.1% | ~CM-8 |
| CM-5 | 93.45 | 1.55 | 2.50 | 4.3% | Drag ~ CM-8 When wiping in nearly dry to dry stages but just beginning to squeak when wet |
| CM-7 | 95.90 | 0.78 | 1.25 | 2.1% | Squeaks when wet until nearly dry. ~CM-8 when completely dry however |
| CM-6 | 100.00 | 0 | 0 | 0% | Excessive squeaking ~ Very difficult to use also not as smooth completely dry as CM-8 |

Notes - See Table I

TABLE VI

EFFECT ON LUBRICITY OF VARYING WATER TO TOTAL ALCOHOL CONTENT USING ISOPROPANOL TO 1-PROPANOL RATIO OF ~ 40:1

BASIC FORMULATION: — $H_2O$ - see below
— Alcohol - see below
0.104g $NH_4OH^{(p)}$
0.10g $K_4B_2O_7 \cdot 4H_2O$
0.10g $NH_4HCO_3$
0.018g Surfactant BA-77[b]
0.20g MPEG-5K[j]
TEST SURFACE: 24" × 18" Plate Glass

| # | $H_2O$ (grams) | Iso-propanol (grams) | 1-propanol (grams) | % Alcohol to $H_2O$ | Lubricity (Comparative drag while wiping with paper towel from wet to dry stage) |
|---|---|---|---|---|---|
| LA-1 | 78.65 | 15.65 | 0.406 | 20.4% | Excellent - Low drag wet to dry stage |
| LA-2 | 85.90 | 10.00 | 0.254 | 11.9% | ~LA-1 |
| LA-3 | 90.85 | 6.10 | 0.152 | 6.9% | ~LA-1<br>A little more drag nearly dry than LA-1, ~ LA-1 when dry. |
| LA-4 | 93.30 | 4.00 | 0.102 | 4.4% | Just on verge of squeaking when being wiped in nearly dry stage<br>More drag nearly dry than LA-4, ~ LA-1 when dry. |
| LA-6 | 95.58 | 3.05 | 0.076 | 3.3% | Considerably more drag nearly dry than LA-1<br>Some squeaking when wiped in wet to nearly dry stage<br>Very bad drag nearly dry, much more than LA-6 |
| LA-5 (CM-6) | 100.00 | 0 | 0 | 0% | Very much more than LA-1 nearly dry but ~ LA-1 dry.<br>Squeaks badly wet to nearly dry. |

Notes - See Table I

The preferred alcoholic content limit is hard to establish solely from a lubricity comparison standpoint as amounts as great as about 50% by weight have been found to provide equivalent lubricity to more moderate amounts as low as about 5% by weight.

In general, it has been found that an alcoholic content in the range of about 7% to about 15% by weight is a good range for most normal window and glass cleaning applications. This range will provide good lubricity as well as suitable wicking, evaporation rates, and oil removal properties. Higher alcoholic content may be required for specialized uses such as for cleaning fluids designed for use during freezing weather. Lower alcoholic content may be desirable in extremely dry and hot climates to slow the evaporation rate.

Higher boiling point, water miscible solvents, such as butyl, ethyl and methyl cellosolve, diethylene glycol, dimethyl ether, carbitol acetate, methoxypropanol, 1,4-butandeiol, etc., can also make useful additives to the cleaning solutions of this invention. For the most part, however, their use has been limited to very small amounts, being included mainly as aids to improving overall lubricity of particular formulations.

The use of larger amounts of such high boiling point water soluble solvents has been found, in general, to slow down evaporative and/or wicking rates to an unacceptable level.

This is unlike many commercial window cleaning formulations where the higher boiler point solvents are often added for the express purpose of slowing the drying rate. This seeming anomoly is undoubtedly due in large part to the highly efficient surfactants, used in many such commercial formulations, that can cause extremely rapid wicking into the toweling. Such highly efficient surfactants and wetting agents cannot be employed in the formulations of this invention, as will be explained later, therefore necessitating, in most instances, the use of the lower boiling point alcohols and limiting the use of the higher boiling point solvents to small amounts.

One of the major goals of this invention has been to produce an improved liquid cleaning solution so that it possesses a high degree of lubricity. That is, minimizing the physical effort required by the user during the wiping operation with the absorbent toweling from the wet to the completely dry stage.

Fortunately, one of the advantages of the use of the polyethylene or methoxypolyethylene glycol in the liquid cleaning solutions of this invention is their lubricating properties. This is especially true for the higher molecular weight polyethylene glycol and methoxypolyethylene glycol compounds that dry as a thin but hard synthetic wax after the liquids have evaporated. The glass or other surface being cleaned becomes particularly smooth and slick when this point is reached.

By the proper use of certain of the higher boiling point organic additives to compliment the alcohols and polyethylene glycols or methoxypolyethylene glycols, a further improvement in overall lubricity can often be achieved during the drying operation with absorbent toweling.

Such additives apparently fill the gap during the period when the alcohol can no longer provide adequate lubricity, (probably due to its evaporation or absorption into the toweling) to the point where the very thin but slick polyethylene glycol and/or methoxypolyethylene glycol surface layer has been established. The latter does not occur until the surface has been wiped to a reasonably dry stage.

It should also be pointed out that some of these higher boiling point organic additives have also been found to increase the final, completely dry, lubricity of the surface. Apparently this is due to the additive causing a more uniform spreading of the polyethylene glycol or methoxypolyethylene glycol during its final drying stage.

Table VII covers examples of a number of these high boiling point organics incorporated in a cleaning solution for the purpose of enhancing the overall lubricity. The basic formulation in this case is similar to that of sample CM-5 of Table V presented earlier except that the 5000 molecular weight methoxypolyethylene glycol has been substituted with polyethylene glycol of the 6,000 molecular weight range. Also, the 2,3-butanediol is replaced with other high boiling point additives except for formulation CP-2 which has been included for lubricity comparison purposes.

propanol for comparison purposes and shows that this particular formulation still provides slightly less drag

TABLE VII

HIGH BOILING POINT ORGANIC ADDITIVES FOR IMPROVING LUBRICITY IN FORMULATION WHEN ALSO USED WITH ISOPROPANOL AND 1-PROPANOL

BASIC FORMULATION: 93.45g $H_2O$
1.55g Isopropanol
2.5g 1-propanol
0.364g $NH_4OH^{(o)}$
0.011g Surfactant BA-77[b]
0.20g PEG-6K[h]
TEST SURFACE: 24" × 18" Plate Glass

| # | High Boiling Point Organic Lubricant | Amount (grams) | Boiling Point of Lubricant | Lubricity - Through Nearly Dry Stage | Lubricity - When in Dry Stage |
|---|---|---|---|---|---|
| CQ-1 | none | — | — | Considerably more drag than CQ-2 | Noticeably more drag than CQ-2 |
| CQ-2 | 2,3-butanediol | 0.026 | 187 C | Excellent | Excellent |
| CQ-3 | 3-Methoxy 1-butanol | 0.144 | 161 C | ~CQ-2 | ~CQ-2 but probably not quite as smooth transition nearly dry to dry |
| CQ-4 | 1-hexanol | 0.018 | 157 C | Less drag than CQ-1 but not quite as low as CQ-2 | Less drag than CQ-1 but not quite as little drag as CQ-2 |
| CQ-5 | Carbitol Acetate | 0.065 | 217.4 C | ~CQ-4 | ~CQ-4 |
| CQ-6 | Diacetone Alcohol | 0.092 | 169 C | ~CQ-4 | ~CQ-4 |
| CQ-7 | 1,3-butanediol | 0.031 | 204 C | Slightly less drag than CQ-4, almost but not quite as low drag as CQ-2 | Slightly less drag than CQ-4, almost but not quite as low drag as CQ-2 |
| CQ-8 | Ethylene glycol di-acetate | 0.123 | 190 C | Definitely more drag than CQ-4. Slightly less drag than CQ-1 however | More drag than CQ-4 and slightly less than CQ-1 |
| CQ-9 | Cellosolve Solvent | 0.293 | 135.6 C | ~CQ-8 | ~CQ-8 |
| CQ-10 | 1,4-butanediol | 0.036 | 230 C | ~CQ-7 | ~CQ-7 |
| CQ-11 | 1,5-pentanediol | 0.032 | 240 C | ~CQ-7 | ~CQ-7 |

[h]Carbowax polyethylene glycol, 6000–7500 molecular weight, Mfg. by Union Carbide Corp., New York, N.Y. Amount shown includes PEG-6000 + $H_2O$ 1:1 by weight
OTHER NOTES - See Table I Table VIII shows additional high boiling point additives used with a formulation somewhat similar to that used in Table IV, except that in Table VIII the high boiling point additive is used to replace the 1-propanol. Sample JB-22 in Table VIII covers the use of the 1-than with any of the other higher boiling point additives tried in its place. As can be seen from the table, however, a number of other organic additives did provide considerable improvement in the overall drag characteristics.

TABLE VIII

HIGH BOILING POINT ORGANIC ADDITIVES FOR IMPROVING LUBRICITY IN FORMULATION WHEN ALSO USED WITH ISOPROPANOL

BASIC FORMULATION: 90.85g $H_2O$
— Alcohol-see below
0.104g $NH_4OH^{(p)}$
0.10g $K_4B_2O_7 \cdot 4H_2O$
0.10g $NH_4HCO$
— Organic Additive see below
0.018g Surfactant BA-77[b]
0.20g MPEG-5K[f]
TEST SURFACE: 24" × 18" Plate Glass

| # | Alcohol and Organic Additives | Amount (grams) | Boiling Point of Additives | Lubricity |
|---|---|---|---|---|
| JB-1 | Isopropanol | 6.10 | 82.3C | |
| | Isopropanol | 2.35 | 82.3C | Considerably less drag nearly dry than JB-1, Also a little less drag |
| JB-2 | 1-propanol | 4.05 | 97.2C | when dry than JB-1 with noticeably better transition wet to completely dry |
| | Isopropanol | 6.10 | 82.3C | |
| JB-6 | 1,3-propanediol | 0.121 | 210 C | ~ JB-2 |
| | Isopropanol | 6.10 | 82.3C | |
| JB-7 | Carbitol Acetate | 0.076 | 217.4C | ~ JB-2 |
| | Isopropanol | 6.10 | 82.3C | |
| JB-8 | Diethylene glycol | | | ~ JB-2 |
| | di-methyl ether | 0.189 | 160 C | |
| | Isopropanol | 6.10 | 82.3C | |
| JB-9 | 3-Methoxy,1-butanol | 0.185 | 161 C | ~ JB-2 |
| | Isopropanol | 6.10 | 82.3C | A little less drag nearly dry than JB-2, Also slightly smoother when |
| JB-14 | 2,3-butanediol | 0.104 | 187 C | completely dry than JB-2 |
| | Isopropanol | 6.10 | 82.3C | |

TABLE VIII-continued

HIGH BOILING POINT ORGANIC ADDITIVES FOR IMPROVING LUBRICITY IN FORMULATION WHEN ALSO USED WITH ISOPROPANOL

BASIC FORMULATION: 90.85g $H_2O$
— Alcohol-see below
0.104g $NH_4OH^{(p)}$
0.10g $K_4B_2O_7 \cdot 4H_2O$
0.10g $NH_4HCO$
— Organic Additive see below
0.018g Surfactant BA-77[b]
0.20g MPEG-5K[f]
TEST SURFACE: 24" × 18" Plate Glass

| # | Alcohol and Organic Additives | Amount (grams) | Boiling Point of Additives | Lubricity |
|---|---|---|---|---|
| JB-11 | 2-Methoxy,1-ethanol | 0.228 | 124 C | ~ JB-2 |
| | Isopropanol | 6.10 | 82.3C | |
| JB-17 | Methoxy propanol | 0.180 | 120 C | ~ JB-2 |
| | Isopropanol | 6.10 | 82.3C | Very slightly less drag nearly dry than JB-2. Not quite as low drag |
| JB-13 | Butyl cellosolve | 0.070 | 171.2C | nearly dry as JB-14. ~ JB-14 completely dry. |
| | Isopropanol | 6.10 | 82.3C | Slightly less drag nearly dry than JB-14. ~ JB-2 completely |
| JB-22 | 1-propanol | 0.160 | 97.2C | dry. |

NOTES - See Table I

Table IX shows still additional samples where the organic lubricant additives have been selected from what can be categorized as high, intermediate and low boiling point ranges. An examination of the formulations LC-2 and LC-1 in this table, shows that variation in the particular polyethylene glycol and/or methoxypolyethylene glycol compound employed, also can have an effect on the overall lubricity of the cleaning solution. In all cases in Table IX, as well as in preceding Tables VII and VIII the specific formulations shown have been optimized for minimum drag characteristics by adjusting the amounts of one or more of the lubricant additives.

To aid in this admittedly very subjective and relative measurement technique, it was found that more critical frictional differences could be determined by lifting the glass plate from the bench surface and placing it on two narrow wooden strips (one at each end). This technique provided a means for adjustment of the friction between the glass plate and the bench so that the glass would just start to move during the circular wiping motions. The difference in the amount of movement noted between formulations was found to provide a very sensitive indication of lubricity differences.

Unless otherwise stated in a particular test configuration, the cleaning liquid was applied in a measured

TABLE IX

ADDITIONAL HIGH BOILING POINT ORGANIC ADDITIVES COMBINED WITH ALCOHOL

BASIC FORMULATION: 90.85g $H_2O$
— Alcohol-see below
0.156g $NH_4OH^{(o)}$
— Organic additive
0.012g Surfactant BX-78[c]
— MPEG or PEG - see below
TEST SURFACE: 24" × 18" Plate Glass

| # | Alcohol and Organic Additives | Amount (grams) | PEG or MPEG | Amount (grams) | Lubricity |
|---|---|---|---|---|---|
| | Isopropanol | 6.1 | | | |
| LC-1 | 1-propanol | 0.160 | MPEG-5K[f] | 0.20 | Slightly more drag nearly dry than LC-2 but |
| | 2,3-butanediol | 0.026 | | | ~LC-2 when dry |
| | Isopropanol | 6.1 | | | |
| LC-2 | 1-propanol | 0.160 | PEGC-2OM[i] | 0.26 | Excellent - Very low drag, wet to dry stage |
| | 2,3-butanediol | 0.039 | | | |
| | Isopropanol | 6.1 | | | |
| LC-3 | 1-propanol | 0.160 | MPEG-5K[f] | 0.20 | Very slightly more drag nearly dry than LC-1 |
| | 1,3-butanediol | 0.31 | | | ~LC-1 and LC-2 when dry |
| | Isopropanol | 6.1 | | | |
| LC-4 | Methoxy propanol | 0.144 | MPEG-5K[f] | 0.20 | ~LC-3 |
| | 2,3-butanediol | 0.026 | | | |

NOTES - See Table I

In this application, lubricity comparisons have been made by repetitive cleaning of a plate glass or mirror surface, 24" X 18", with the particular formulation being evaluated. A comparison is made with another formulation while noting the differences in friction or drag while wiping with absorbent toweling from the wet, through the intermediate drying stages, to the completely dry condition.

amount (normally about 1.5 g) from an eyedropper to the center of the glass plate. The liquid was then spread out to a diameter of about 8–10 inches with the finger tips, before starting the wiping operation with a single dry paper towel. Little difference could be found between this mode of application and applying by means of a fine spray from an atomizer type container. It was felt that the eyedropper method would provide a more accurate control of the amount of liquid applied for these comparison tests.

In an attempt to make the relative lubricity measurements more meaningful, comparison was also made with commercially available window cleaners presently available on the market. The cleaners selected were WINDEX, GLASS PLUS, AJAX and EASY-OFF. These were initially compared with each other in the manner just described. In general, it was found that WINDEX provided equivalent, or in some cases superior lubricity throughout the entire wiping transition from the wet to the completely dry stage, to any of the others listed. WINDEX was therefore arbitrarily selected as the commercially available standard with which formulations of the present invention have been compared from a lubricity standpoint.

Table X includes some of the optimized formulations from Tables III, IV, VII, VIII and IX, that have been compared directly with WINDEX. Notations are made for the wet, nearly dry and dry stages during the wiping operation with the absorbent toweling. This table shows that comparatively excellent lubricity (low drag) can be achieved with polyethylene glycol and/or methoxypolyethylene glycol containing window and glass cleaning solutions of this invention.

It has been found that ammonium hydroxide can be added to most polyethylene glycol and/or methoxypolyethylene glycol containing formulations in large amounts without any apparent deleterious effect on the cleaning action. As a practical matter, the ammonia content should be limited to an amount that can be reasonably and safely tolerated by the user. For window and glass cleaner applications for household use, the pH of the final solution has, in the preferred formulations for such use, been limited to no more than 10 and preferably to a value closer to 9.5.

In addition to the use of ammonium hydroxide, a large number of other additives to assist in oil and grease film cutting have been evaluated.

Some of these such as sodium oleate, sodium lauryl sulfate, and sodium caseinate were not found to be suitable due to severe glass streaking problems when included in the cleaning solution formulations. Others, such as sodium and potassium hydroxide were not considered because of the potential danger of etching the glass, over long period of time, due to residual amounts of the hydroxide being left on the surface.

However, a number of other grease cutting additives have been evaluated and found to provide a degree of effectiveness in respect to oil and grease film removal

TABLE X

LUBRICITY COMPARISONS BETWEEN SELECTED FORMULATIONS AND A COMMERCIALLY AVAILABLE WINDOW AND GLASS CLEANING PRODUCT

TEST SURFACE: 24" × 18" Plate Glass

| # | For Formulation See Table: | Lubricity Wet Stage | Nearly Dry Stage | Dry Stage |
|---|---|---|---|---|
| WINDEX | Commercial Product | ~JB-22 | Noticeably more drag than CJ-1 | Noticeably more drag than CJ-1 |
| CJ-1 | Table III | ~JB-22 | Noticeably more drag than JB-22 | More drag than JB-22 |
| CJ-4 | Table III | ~JB-22 | Less drag than CJ-1 More drag than JB-22 | ~JB-22 |
| JB-22 | Table IV | ~JB-22 | Excellent - very low drag wet to dry stage | Excellent - very low drag wet to dry stage |
| CQ-2 | TABLE VII | ~JB-22 | Less drag than CJ-1 but a little more than CJ-4 | Slightly less drag than CJ-1 but not quite as little drag as JB-22 |
| JB-14 | Table VIII | ~JB-22 | Not quite as low drag as JB-22 but a little less drag than CJ-4 | ~CJ-1 More drag than JB-22 |
| LC-2 | Table IX | ~JB-22 | ~JB-22 | ~JB-22, but overall not quite as as smooth transition nearly dry to completely dry |

Ammonium hydroxide has been used as an additive in most prior art liquid window and glass cleaners. It has also been found to be extremely useful with the present invention. It forms an ammonia soap, saponifying oils and fast and is classed as a detergent.

The major advantage of the use of ammonium hydroxide in a liquid cleaner over that of other oil and grease cutters such as the phosphates, borates, etc., is that complete evaporation occurs by the time the surface has been wiped dry and no residue is left behind.

from glass and other smooth surfaces. These include one or more of the borates, carbonates, silicates, citrates, phosphates, gluconates, glycolates, etc. which may also be used with added amounts of ammonium hydroxide.

Table XI shows a number of examples where different grease-cutting additives have been used with a basic cleaner formulation. The lubricity comparisons were made as previously explained.

TABLE XI

EFFECT OF VARIOUS GREASE CUTTING ADDITIVES ON LUBRICITY, RESIDUAL CONTAMINATION AND OIL REMOVAL PROPERTIES

BASIC FORMULATION: 90.8g $H_2O$, 2.35g Isopropanol, 4.05g 1-propanol, 0.364g $NH_4OH^{(o)}$, 0.011g Surfactant BA-77$^{(b)}$, 0.20g MPEG-5K$^{(l)}$ TEST SURFACE: 24" × 18" lubricity test: Plate Glass; other tests single strength mirror

| # | Oil and Grease Cutting Additive | Amount (grams) | Lubricity - | Residual Contamination Test (Clean Glass) | Oil Removal Test (1 Drop WESSON Oil) |
|---|---|---|---|---|---|
| IK-8 | None | — | | None | Very clean |
| IK-23 | $Na_3C_6H_5O_7 . 2H_2O$ | 0.1 | Definitely more drag both nearly dry and dry than IK-8 | None when first applied but gets cloudy in certain areas when breathed on | Clean |
| IK-24 | $(NH_4)_2HC_6H_5O_7$ | 0.1 | ~IK-23 | ~IK-23 | Clean |
| IK-25 | $K_3C_6H_5O_7 . H_2O$ | 0.1 | ~IK-23 | ~IK-23 | Clean |
| IK-26 | Gluconic Acid$^{(k)}$ (50%) | 0.143 | ~IK-8 | None | Very Clean |
| IK-27 | $KBO_2 . \times H_2O$ | 0.1 | A little more drag than IK-8 both nearly dry and dry | None | Extremely Clean |
| IK-28 | $K_3PO_4 . \times H_2O$ | 0.1 | ~IK-27 | None | Very Clean |
| IK-29 | $K_4P_2O_7$ | 0.1 | A little more drag nearly dry than IK-28 | None 1st application but builds up a film with repeated application | Very clean |
| IK-30 | $K_5P_3O_{10}$ | 0.1 | ~IK-29 | ~IK-29 | Clean |
| IK-31 | $(NaPO_3)_6$ | 0.1 | ~IK-29 | ~IK-29 | A few oil streaks |
| IK-32 | Glycolic Acid$^{(k)}$ (70% Min.) | 0.132 | ~IK-23 | ~IK-23 | Clean |
| IK-33 | $K_2B_4O_7 . 4H_2O$ | 0.1 | ~IK-27 | None | Extremely clean ~ IK-27 |
| FB-4 | $NaBO_3 . 4H_2O$ | 0.1 | ~IK-29 | None | Very clean |
| FA-13 | $NaSiO_3 . 9H_2O$ | 0.1 | ~IK-29 | None | Very clean |
| FB-11 | $Na_2CO_3 . 10H_2O$ | 0.1 | ~IK-29 | None | Very clean |

$^{(k)}NH_4OH$ content doubled in order to have sufficient excess to react with the acid so as to form the appropriate ammonium compound OTHER NOTES - See Table I The "oil removal test" in Table XI, and in subsequent tables of this application unless otherwise specified, consists of placing one drop (~1.5 g) of oil (in this instance a vegetable oil sold as WESSON oil) in the center of the glass plate test surface. The oil is then rubbed onto the center area of the plate to a diameter of about 8" with the heel of the hand. Next, a measured amount of the specified cleaning formulation is applied to the center of the glass plate with an eyedropper (normally being about 1.5 g of liquid) and is then mixed into the oil film, to at least partially emulsify the mixture, with the tips of the fingers.

The mixture is then wiped from the glass surface with a single paper towel. The emulsified liquid is spread over the entire surface of the glass plate by means of the paper towel at the start of the wiping operation.

When the surface has been wiped completely dry, examination for oil streaks and residue is made under a 500 watt type EAL photoflood lamp or in bright sunlight (no clouds). In either case, the light is reflected onto the glass surface being examined but is not allowed to get behind the observer. In this way, the best possible observation of contaminating films and streaks on the glass has been found to be possible.

As will be explained in more detail later, the "oil removal test", included in Table XI and other tables in this application, is in actuality very severe. It is used to make sure that the inherent oil removal properties of the liquid cleaner solutions of this invention, due to the inclusion of the polyethylene glycol or methoxypolyethylene glycol additive, has not been adversely affected by the incorporation of other additives.

The "residual streaking test" on the clean glass surface is made in the same manner as just explained for the oil removal test except that no oil is used. That is, the liquid formulation is applied to the center of the clean glass surface in a measured amount (again, normally ~1.5 g). The liquid is then spread out on the glass to a diameter of about 8–10" with the finger tips, and then wiped dry using a single paper towel. Again, the liquid is spread over the entire surface of the glass plate by means of the paper towel at the start of the wiping operation. Examination is by means of the same lighting method also described earlier.

The "residual streaking test" on an already clean glass surface has been included in Table XI, and other tables in this application, to determine if added solids are being left behind as a visible residue. It is also a way of making sure that the polyethylene glycol and/or methoxypolyethylene glycol additive in these formulations is ultimately applied to the glass surface in a uniform, ultra thin and invisible film.

Two of the formulations in Table XI, #IK-27 and #IK-33, respectively, even with excessive oil present showed excellent oil film removal properties. These were formulations incorporating potassium metaborate and potassium tetraborate, respectively, as the grease cutting additives.

For the nominal amounts of additives used in these various formulations in Table XI, none caused residual streaking on the clean glass (at least for the initial application). It has been found, however, that the majority of the phosphates will cause a cloudy film to build up on the glass surface after several repeated applications, making their use in a practical glass cleaning solution very questionable. The only phosphates that have been found that do not exhibit this property to an objectionable degree are the tribasic sodium and potassium phosphates ($Na_3PO_4$ and $K_3PO_4$).

The reason for this strange behavior of many of the phosphate additives is not understood, but it is suspected that some combination occurs between the phosphate and the polyethylene glycol and/or methoxypolyethylene glycol present in the solution.

The citrates were found in subsequent tests to do an excellent job of aged oil film removal when used as an additive to formulations of this invention. However, as can be seen in test samples IK-23, IK-24 and IK-25 in Table XI, even when used in the small quantities employed here, their use causes a cloudy residue to appear when the glass is breathed on or is left in a humid atmosphere.

The most disappointing finding while conducting the tests of Table XI was that even with the very small percentages involved, almost every grease cutting additive tried caused a noticeable increase in the drag while wiping the glass surface from the wet to the dry stage with absorbent toweling.

A concerted effort was therefore made to try and find an oil and grease cutting additive that would be effective but hopefully at the same time not degrade the overall lubricity properties of the cleaner when used in amounts sufficient to be effective.

During the course of this evaluation a unique finding was made. Not only was a family of effective inorganic oil and grease cutting additives found, but is was also discovered that these additives were capable of providing even greater lubricity to the polyethylene glycol and/or methoxypolyethylene glycol containing formulations of this invention than had previously been possible through the use of organic lubricants alone. This family of additives constitutes ammonium bicarbonate, ammonium carbonate and mixtures thereof, or mixtures of ammonium carbonate and ammonium carbamate.

Ammonium bicarbonate ($NH_4H\ CO_3$) is a well defined inorganic compound, soluble in water, is nontoxic, has a specific gravity of 1.586 and decomposes in air evolving ammonia and carbon dioxide gas at 36° C. to 60° C. Ammonium carbonate, on the other hand, is defined, depending on the reference source or supplier as $(NH_4)_2CO_3$, $(NH_4)_2CO_3 \cdot 2H_2O$ or as an unspecified mixture of ammonium carbonate and ammonium carbamate ($NH_4CO_2NH_2$). Ammonium carbamate by itself has been tested and found to slightly degrade lubricative effects in this application. However, the ammonium carbonate stated to be a mixture containing ammonium carbamate gave excellent results from the lubricity standpoint. Ammonium carbonate is unstable in air, decomposing to ammonium bicarbonate.

Both the ammonium bicarbonate and carbonate were found to be stable in water solution to at least 150° F. At 160° F. the ammonium carbonate appears, from pH measurements after the solution was cooled to room temperature, to have converted to the bicarbonate form. Temperatures well below 150° F. would be expected for normal shipping, storage and use conditions. The upper temperature limit for the use of the bicarbonate has not been determined.

The reason for the greatly improved lubricity characteristics obtained by the addition of the ammonium bicarbonate or carbonate is not known. This may be due entirely to a unique crystal structure of these particular ammonia compounds. A more plausible explanation, however, is that during the wiping and drying of the liquid cleaner against the surface being cleaned (by the absorbent toweling) sufficient rubbing action occurs to cause at least partial decomposition of the ammonium compound(s). Whether the decreased friction is due to physical changes in the ammonium carbonate (or bicarbonate) crystal structure during this rubbing operation or the formation of a carbon dioxide-ammonia gas film, or both, is open to question. In any event, it has been found that the addition of these inorganic compounds greatly increases the lubricity of such liquid cleaning solutions during the partially dry to nearly dry and even the completely dry stages.

Table XII shows tests run with varying amounts of ammonium bicarbonate and ammonium carbonate added to an otherwise standard formulation. In this test the ammonium bicarbonate was a "certified" grade and the ammonium carbonate a "purified" grade. Although not included in the table, a "certified" grade of ammonium carbonate consisting of "a mixture of ammonium carbonate and ammonium carbamate of varying proportions" was also tried with equivalent results to the ammonium carbonate. Ammonium carbamate was also used in place of the ammonium bicarbonate or carbonate with this same basic formulation and found to impart a slight reduction in lubricity.

TABLE XII

EFFECT OF VARYING AMOUNTS OF AMMONIUM BICARBONATE AND AMMONIUM CARBONATE ADDITIVES ON LUBRICITY, RESIDUAL CONTAMINATION AND OIL REMOVAL PROPERTIES

BASIC FORMULATION: 90.85g $H_2O$; 6.10g Isopropanol; 0.16g 1-propanol; 0.104g $NH_4OH^{(p)}$ — Carbonate-see below; 0.018g Surfactant BA-77$^{(b)}$; 0.20g MPEG-5K$^{(f)}$ TEST SURFACE: 24" × 18" Lubricity Test: Plate Glass; other tests single strength mirror

| # | Carbonate Additive | Amount (grams) | Lubricity | Residual Contamination (Clean Glass) | Oil Residual Test (1 Drop WESSON Oil) |
|---|---|---|---|---|---|
| JE-1 | None | — | Slightly more drag nearly dry than JE-3 and JE-5. | None | Clean to Very Clean |

TABLE XII-continued

EFFECT OF VARYING AMOUNTS OF AMMONIUM BICARBONATE AND AMMONIUM CARBONATE ADDITIVES ON LUBRICITY, RESIDUAL CONTAMINATION AND OIL REMOVAL PROPERTIES

BASIC FORMULATION: 90.85g $H_2O$
6.10g Isopropanol
0.16g 1-propanol
0.104g $NH_4OH^{(p)}$
— Carbonate-see below
0.018g Surfactant BA-77[b]
0.20g MPEG-5K[j]

TEST SURFACE: 24" × 18" Lubricity Test: Plate Glass; other tests single strength mirror

| # | Carbonate Additive | Amount (grams) | Lubricity | Residual Contamination (Clean Glass) | Oil Residual Test (1 Drop WESSON Oil) |
|---|---|---|---|---|---|
| JE-2 | $NH_4HCO_3$ | 0.05 | ~Same dry | None | Very Clean |
| JE-5 | $NH_4HCO_3$ | 0.075 | Excellent-much less drag than JE-1 both nearly dry and dry. Excellent transition wet to dry | None | Very Clean |
| JE-3 | $NH_4HCO_3$ | 0.10 | Excellent- ~ JE-5 Can't tell difference | None | Very Clean |
| JE-4 | $NH_4HCO_3$ | 0.15 | A little more drag nearly dry than JE-3 and JE-5. ~ same dry. Very slightly more drag than JE-2 nearly dry but better dry | None | Very Clean |
| JE-6 | $(NH_4)_2CO_3$ | 0.05 | Slightly more drag nearly dry than JE-9 but ~ same dry. Definitely less drag than JE-1 both nearly dry and dry | None | Very Clean |
| JE-9 | $(NH_4)_2CO_3$ | 0.075 | Excellent- ~ JE-5 Can't tell difference | None | Very Clean |
| JE-7 | $(NH_4)_2CO_3$ | 0.10 | Excellent- ~ JE-9 Can't tell difference | None | Very Clean |
| JE-8 | $(NH_4)_2CO_3$ | 0.15 | Very slightly more drag than JE-6 nearly dry. ~ JE-9 and JE-7 when dry | None | Very Clean |

NOTES - See Table I

As can be seen in Table XII, the 0.075–0.15 gram range appeared to be optimum for obtaining minimum drag from either the ammonium bicarbonate or ammonium carbonate additives with this basic formulation. No discernible difference between the use of the two compounds could be found as far as this test was concerned. The same proportions of water to ammonium bicarbonate or carbonate content also appear to be optimum with other formulation variations; however, amounts as low as 0.025 grams of carbonate or bicarbonate to as great as 0.3 grams to 92.5 grams of $H_2O$ or on the order of 3 weight percent have been used without undue drag or residual deposits on the glass.

An additional finding of considerable importance is that a number of other grease cutting additives, that in themselves will cause a noticeable increase in the drag characteristics, can be used without degradation of lubricity when used in combination with one of the ammonium carbonate, ammonium bicarbonate family of compounds. In fact, in many cases, the lubricity can be as good as if the ammonium compound were used alone. Table XIII shows a number of formulations using this type of combination.

TABLE XIII

EFFECT OF GREASE CUTTING ADDITIVES LUBRICITY AND OTHER PROPERTIES WHEN USED IN COMBINATION WITH AMMONIUM BICARBONATE

BASIC FORMULATION: 90.8g $H_2O$
2.35g Isopropanol
4.05g 1-propanol
0.104g $NH_4OH^{(o)}$
— Grease Cutting Additive-see below
0.011g Surfactant BA-77[b]
0.27g PEG 20K linear[j]

TEST SURFACE: 24" × 18" Lubricity Test: Plate Glass; other tests single strength mirror

| # | Grease Cutting Additive | Amount (grams) | Lubricity | Residual Contamination Test (Clean Glass) | Oil Removal Test (1 Drop WESSON Oil) |
|---|---|---|---|---|---|
| IX-49 | None | — | Considerably more drag nearly dry than IX-45 and a little more drag completely dry | None - Leaves clean glass surface | Clean |
| IX-45 | $NH_4HCO_3$ | 0.1 | Excellent - Very low drag | None - Leaves very clean glass surface | Very Clean |
| IX-3 | $NH_4HCO_3$<br>$KBO_2 . \times H_2O$ | 0.1<br>0.1 | ~IX-45 | None - Leaves exceptionally clean glass surface | Exceptionally Clean |

TABLE XIII-continued

EFFECT OF GREASE CUTTING ADDITIVES LUBRICITY AND OTHER PROPERTIES WHEN USED IN COMBINATION WITH AMMONIUM BICARBONATE

BASIC FORMULATION: 90.8g $H_2O$
2.35g Isopropanol
4.05g 1-propanol
0.104g $NH_4OH^{(o)}$
— Grease Cutting Additive-see below
0.011g Surfactant BA-77[b]
0.27g PEG 20K linear[j]

TEST SURFACE: 24" × 18" Lubricity Test: Plate Glass; other tests single strength mirror

| # | Grease Cutting Additive | Amount (grams) | Lubricity | Residual Contamination Test (Clean Glass) | Oil Removal Test (1 Drop WESSON Oil) |
|---|---|---|---|---|---|
| | $NH_4HCO_3$ | 0.1 | | | |
| IX-21 | $K_2B_4O_7 . 4H_2O$ | 0.1 | ~IX-45 | ~IX-3 Almost none - Slight cloudy film in a few areas, especially corners when breathed on | ~IX-3 |
| | $NH_4HCO_3$ | | | | |
| | Gluconic Acid[k] | 0.1 | | | |
| IX-5 | (50%) | 0.088 | ~IX-45 | | ~IX-45 |
| | $NH_4HCO_3$ | 0.1 | ~IX-45 (When using 0.1 g sodium citrate drag is increased over that nearly dry of IX-45) | | |
| IX-9 | $Na_3C_6H_5O_7 . 2H_2O$ | 0.05 | | ~IX-5 | ~IX-45 |
| | $NH_4HCO_3$ | 0.1 | | | |
| IX-2 | $Na_3PO_4 . 12H_2O$ | 0.1 | ~IX-45 | ~IX-45 | ~IX-45 |
| | $NH_4HCO_3$ | 0.1 | Very slightly more drag nearly dry to dry than IX-45 | | |
| IX-19 | $NaBO_3 . 4H_2O$ | 0.1 | | ~IX-45 | ~IX-45 |
| | $(NH_4)_2CO_3$ | 0.1 | | | |
| IX-60 | $KBO_2 . \times H_2O$ | 0.1 | ~IX-3 Can't tell difference | ~IX-3 | ~IX-3 |

[j]Carbowax polyethylene glycol, 18,000–19,000 molecular weight, Mfg. by Union Carbide Corporation, New York, N.Y. Amount shown includes PEG-20,000 linear + $H_2O$ 1:2 by weight OTHER NOTES - See Tables I & XI As can be seen from the table, the best overall results were obtained from formulations IX-3 and IX-4 containing the potassium metaborate and potassium tetraborate, respectively. Not only was the lubricity excellent but in addition, repeated tests and comparisons showed that the glass surface was left in an exceptionally clean condition, both with clean and oil contaminated glass prior to its use. Also, there is absolutely no indication of any cloudy film when the freshly cleaned surface is breathed on or placed in a humid atmosphere.

An examination of formulations IX-6 and IX-9 in Table XIII shows that while the lubricity is excellent with the ammonium bicarbonate present, the use of the citrate and glycolate in the proportions involved here tend to leave a cloudy film on portions of the glass, (especially in the corners or at the edges where an excess probably can build up) when used in high humidity conditions. The citrate, in particular, because of its observed excellent oil and grease cutting properties when used in such formulations could, however, be considered for uses other than cleaning windows and mirrors where the highest optical clarity may not be important.

In subsequent tests with sodium citrate, potassium citrate, and ammonium citrate, it is interesting to note that only the sodium citrate provided low drag characteristics when used in combination with the ammonium bicarbonate.

A similar situation was found in the use of trisodium phosphate ($Na_3PO_4 \cdot 12H_2O$) as compared to tri-potassium phosphate ($K_3PO_4 \cdot H_2O$). Again, the sodium compound was found to provide no additional drag when used with ammonium carbonate or ammonium bicarbonate while the tri-potassium phosphate added very considerable drag.

In the case of the borates, the reverse situation, although not as pronounced, exists. That is, the potassium metaborate and potassium tetraborate provided noticeably lower drag characteristics than their sodium counterparts when used with the ammonium carbonate or ammonium bicarbonate lubricant system.

As stated earlier, ammonium hydroxide has often been incorporated in the preferred formulations of this invention. While by no means a necessity, it can assist in the overall oil, grease and other contamination removal from the surface being cleaned without fear of leaving residual deposits.

Table XIV provides an idea of changes in pH that can be expected with varying the amount of ammonium hydroxide (28% $NH_3$) added to three difference basic formulations: one with no added grease cutters, one with ammonium bicarbonate and potassium tetraborate, and one with ammonium bicarbonate and the more basic potassium metaborate.

TABLE XIV

EFFECT OF ADDING AMMONIUM HYDROXIDE ON pH OF THREE FORMULATIONS WITH AND WITHOUT GREASE CUTTING ADDITIVES

BASIC FORMULATIONS
85.9g $H_2O$
10.00g Isopropanol
0.261g 1-propanol
— $NH_4OH^{(p)}$-see below
— Grease Cutters-see below
— Organic Lubricant see below
0.012g Surfactant BX-78[e]
0.26g PEGC-20M[f]

| # | Additives(s) | Amount | pH | # | Additive(s) | Amount | pH | # | Additive(s) | Amount | pH |
|---|---|---|---|---|---|---|---|---|---|---|---|
| J-1 | None | — | ~5 | JD-1 | None | — | ~5 | JN-1 | None | — | ~5 |
| J-2 | 2,3-butanediol | 0.039 | ~5 | JD-2 | $NH_4HCO_3$ | 0.08 | ~6 | JN-2 | $NH_4HCO_3$ | 0.08 | ~6 |
| | 2,3-butanediol | 0.039 | | | $NH_4HCO_3$ | 0.08 | | | $NH_4HCO_3$ | 0.08 | |
| J-3 | | | ~8.5 | JD-3 | | | ~8.5 | JN-3 | | | ~9 |
| | $NH_4OH$ | 0.052 | | | $K_2B_4O_7 . 4H_2O$ | 0.10 | | | $KBO_2 . \times H_2O$ | 0.10 | |
| | 2,3-butandediol | 0.039 | | | $NH_4HCO_3$ | 0.08 | | | $NH_4HCO_3$ | 0.08 | |
| J-4 | | | ~9 | JD-4 | $K_2B_4O_7 . 4H_2O$ | 0.10 | ~9 | JN-4 | $KBO_2 . \times H_2O$ | 0.10 | ~9.5 |
| | $NH_4OH$ | 0.104 | | | $NH_4OH$ | 0.052 | | | $NH_4OH$ | 0.052 | |
| | 2,3-butanediol | 0.039 | | | $NH_4HCO_3$ | 0.08 | | | $NH_4HCO_3$ | 0.08 | |
| J-5 | | | ~9.5 | JD-5 | $K_2B_4O_7 . 4H_2O$ | 0.10 | ~9.5 | JN-5 | $KBO_2 . \times H_2O$ | 0.10 | ~10 |
| | $NH_4OH$ | 0.156 | | | $NH_4OH$ | 0.104 | | | $NH_4OH$ | 0.104 | |
| | 2,3-butanediol | 0.039 | | | $NH_4HCO_3$ | 0.08 | | | | | |
| J-6 | | | ~10 | JD-6 | $K_2B_4O_7 . \times 4H_2O$ | 0.10 | ~10 | | | | |
| | $NH_4OH$ | 0.208 | | | $NH_4OH$ | 0.156 | | | | | |
| J-7 | 2,3-butanediol | 0.039 | ~10.2 | | | | | | | | |
| | $NH_4OH$ | 0.260 | | | | | | | | | |
| J-9 | 2,3-butanediol | 0.039 | ~10.5 | | | | | | | | |
| | $NH_4OH$ | 0.364 | | | | | | | | | |

NOTES - See Table I

Table XV shows some tests made with a variety of grease and oil cutting additives to determine their relative ability to cut aged vegetable oil and aged animal fat films on a flat mirror surface. The vegetable oil (WESSON oil) and animal fat (bacon grease) was carefully spread as a uniform but thin film over the surface of several 24"×18" test mirrors and allowed to age for a little over three days. The test was conducted by simply applying a given amount of the cleaning solution to approximately one-half of the mirror surface, and then rubbing and wiping the surface with a paper towel until dry. The surface was then lightly washed with a wet sponge with clean tap water. This removed any well emulsified oil and fat and any residual cleaner that might have remained on the surface. The areas of glass still having oil and fat film attached could be easily seen at this point because of the water film separation.

TABLE XV

EFFECT OF OIL & GREASE CUTTING ADDITIVES ON REMOVAL OF AGED OIL AND GREASE FILMS

BASIC FORMULATION:
90.8g $H_2O$
2.3g Isopropanol
4.05g 1-propanol
0.104g $NH_4OH^{(p)}$
— Grease Cutting Aid -see below
0.011g Surfactant BA-77[b]
0.27g PEG-20,000 linear TEST SURFACE: 24" × 18" Single Strength Mirror

| # | Oil and Grease Cutting Additives | Amount (grams) | Aged Vegetable Oil and Animal Fat Film Removal Tests[1] (Results were essentially the same for both types of film) |
|---|---|---|---|
| IX-49 | None | — | |
| IX-45 | $NH_4HCO_3$ | 0.1 | A little better film removal than IX-49 but not as good as IX-3 |
| IX-7 | $NH_4HCO_3$ | 0.1 | |
| | $Na_3C_6H_5O_7 . 2H_2O$ | 0.1 | Best film removal properties in test |
| IX-7A | $NH_4HCO_3$ | 0.1 | |
| | $Na_3C_6H_5O_7 . 2H_2O$ | 0.05 | Not quite as good film removal as IX-7 |
| IX-5 | $NH_4HCO_3$ | 0.1 | Not quite as good film removal as IX-3, probably just slightly better than |
| | Glycolic Acid[k] | 0.09 | IX-45 but hard to tell |
| IX-3 | $NH_4HCO_3$ | 0.1 | |
| | $KBO_2 . \times H_2O$ | 0.1 | Not quite as good film removal as IX-7A and IX-2 |
| IX-2 | $NH_4HCO_3$ | 0.1 | |
| | $Na_3PO_4 . 12H_2O$ | 0.1 | ~IX-7A |
| WINDEX | Commercial Product | — | ~IX-7A and IX-2 |

[1]Vegetable oil film was WESSON Oil. Animal fat film was bacon grease. Both films applied to flat mirror surface as thin films and aged 3 days before starting test
OTHER NOTES - See Tables I, XI & XIII It should be stated that the comparisons in Table XV are necessarily relative and also somewhat crude in nature. The principal conclusions that may be made is that, for the amounts of grease cutting additives present, the sodium citrate containing formulation, IX-7, did the best film removal job and the tri-sodium phosphate, IX-2, the next best with the potassium metaborate, IX-3, a close third.

As well as being a most effective lubricating aid, results of formulation IX-45 in the table shows that the ammonium bicarbonate is also acting as an oil and grease cutting additive.

WINDEX, a commercially available window and glass cleaner was also included in this test and gave film cutting results that were roughly equivalent to the tri-sodium phosphate of formulation IX-2. Each test in Table XV was repeated at least twice using a new, contaminated mirror surface.

An important finding is that the ammonium bicarbonate or carbonate is not dependent on the presence of polyethylene glycol and/or methoxypolyethylene glycol in the solution for the achievement of its unique lubricating properties.

It has been found, for example, that the ammonium carbonate or ammonium bicarbonate can be added in small amounts to a variety of window, glass and chrome cleaners presently on the market and show a significant increase in the overall lubricity of such products.

Table XVI shows comparisons of several such household type window cleaners purchased on the market. Ammonium bicarbonate as a lubricant has been added to one sample of each type of cleaner listed in the table but not to the other. Also included is another one of the formulations of my invention, for comparison purposes.

It will be noted that, in every instance, the addition of the ammonium bicarbonate has dramatically decreased the drag properties found for any given type of cleaner while it is being wiped from the wet to the dry stage with a paper towel.

TABLE XVI

COMPARISONS OF FORMULATION EB-2 AND COMMERCIAL WINDOW AND GLASS CLEANERS WITH AND WITHOUT AMMONIUM BICARBONATE ADDED AS INORGANIC LUBRICANT

| | |
|---|---|
| BASIC FORMULATION For # EB-2 Only: | 92.5g $H_2O$<br>2.40g Isopropanol<br>3.160g 1-propanol<br>0.36g $NH_4OH^{(o)}$<br>0.016g Surfactant BA-77$^{(b)}$<br>0.16g MPEG-5K$^{(j)}$ |
| TEST SURFACE: | 24" × 18" Lubricity Test: Plate Glass; other tests single strength mirror |

| # | Formulation | Amount (grams) | Lubricity | Oil Removal Test (1 Drop WESSON Oil) |
|---|---|---|---|---|
| 0 | #EB-2 (see above) | 100 | Considerably more drag nearly dry and a little more drag completley dry than #1. Also a little less drag than #2 both nearly dry and dry | Clean |
| 1 | #EB-2<br>$NH_4HCO_3$ | 100<br>0.10 | Excellent - Low drag nearly dry and dry. Very good transition wet to completely dry | Very Clean |
| 2 | WINDEX | 100 | Much more drag than #1, especially noticeable when nearly dry | A great many oil streaks all over surface |
| 3 | WINDEX<br>$NH_4HCO_3$ | 100<br>0.10 | ~#1 nearly dry. Much less drag than #2 nearly dry and noticeably smoother when completely dry | A great many oil streaks all over surface |
| 4 | GLASS PLUS | 100 | ~#2 but probably very slightly more drag when nearly dry | A great many oil streaks all over surface |
| 5 | GLASS PLUS<br>$NH_4HCO_3$ | 100<br>0.10 | ~3 Hard to tell any difference but probably very slightly more drag when completely dry | A great many oil streaks all over surface |
| 6 | AJAX | 100 | ~2 Hard to tell any difference | A great many oil streaks all over surface |
| 7 | AJAX<br>$NH_4HCO_3$ | 100<br>0.10 | ~3 Hard to tell any difference | A great many oil streaks all over surface |
| 8 | EASY OFF | 100 | Definitely more drag than #2 including more drag wet nearly dry and completely dry | A great many oil streaks all over surface |
| 9 | EASY OFF<br>$NH_4HCO_3$ | 100<br>0.10 | Much less drag wet to nearly dry than #8 but still considerable drag completely dry | A great many oil streaks all over surface |

NOTES - See Table I

Table XVIA shows the use of both ammonium bicarbonate and ammonium carbonate in varying amounts added to WINDEX. The results show that maximum lubricity is obtained with 0.1 grams per 98.2 grams of WINDEX for both types of carbonate additives although a range from about 0.05 grams to about 0.3 grams have been used with success. Essentially no difference from a lubricity standpoint could be determined between the use of ammonium bicarbonate or the ammonium carbonate.

Surface active agents (or surfactants) have been found to be useful additives to the liquid cleaning solutions of this invention. Only certain surfactants have been found to be helpful, however, and these have all been from a group that are primarily classed as wetting agents and penetrating agents. Their main function in this application is to enhance wicking of the cleaning solution into the absorbent toweling used to wipe and dry the surface being cleaned. They also help the spreading of the solution over the surface to which the solution is being applied.

cause fogging, an undue increase in drag while wiping the surface dry, nor introduce other undesirable side effects.

TABLE XVI A

EFFECT OF VARYING AMOUNTS OF AMMONIUM BICARBONATE AND AMMONIUM CARBONATE ON LUBRICITY OF WINDEX, A COMMERCIAL WINDOW AND CLASS CLEANER

BASIC FORMULATION: 98.2g WINDEX —Carbonate Additive see below

TEST SURFACE: 24" × 8" Lubricity Test: Plate Glass; other tests single strength mirror

| # | Additive | Amount (grams) | Lubricity | Residual Contamination Test (Clean Class) |
|---|---|---|---|---|
| LE-1 | None | | A lot more drag nearly dry than LE-4, also noticeably more drag when dry | Extremely Clean |
| LE-1.5 | $NH_4HCO_3$ | 0.025 | A little less drag than LE-1, but more drag than LE-2, both nearly dry and when dry | Extremely Clean |
| LE-2 | $NH_4HCO_3$ | 0.05 | Noticeably less drag nearly dry and completely dry than LE-1. A little more drag nearly dry and dry than LE-4 | Extremely Clean |
| LE-3 | $NH_4HCO_3$ | 0.075 | Very slightly more drag nearly dry than LE-4 but ~ same dry | Extremely Clean |
| LE-4 | $NH_4HCO_3$ | 0.10 | Very low drag - good transition wet to dry | Extremely Clean |
| LE-5 | $NH_4HCO_3$ | 0.125 | ~ LE-3 | Extremely Clean |
| LE-6 | $NH_4HCO_3$ | 0.15 | ~ LE-2 Both nearly dry and dry | Extremely Clean |
| LE-6.5 | $NH_4HCO_3$ | 0.3 | ~ LE-1.5 Nearly dry, not quite as smooth as LE-4 appears to have slight residue on surface of glass when first reaching dry stage | Extremely Clean |
| LE-7 | $NH_4HCO_3$<br>$KBO_2 . \times H_2O$ | 0.1<br>0.1 | ~ LE-4 (and LE-9) Can't tell any difference | Extremely Clean |
| LE-8 | $(NH_4)_2CO_3$ | 0.05 | ~ LE-2 | Extremely Clean |
| LE-9 | $(NH_4)_2CO_3$ | 0.1 | ~ LE-4 | Extremely Clean |
| LE-10 | $(NH_4)_2CO_3$ | 0.15 | ~ LE-6 | Extremely Clean |

It is of primary importance that the surfactant used is not so powerful in its detersive and emulsifying properties as to cause a combination or mixing to any noticeable degree of the oil and grease contamination with the polyethylene or methoxypolyethylene glycol constituent of the cleaning solution. Should such a combination occur, the inherent oil and grease repelling action of the polyethylene and/or methoxypolyethylene glycol additive will be reduced or lost.

The surfactant selected for use in these liquid cleaning solutions should also leave no noticeable residue nor Table XVII contains a list of several surfactants, classed as wetting and penetrating agents, that have been found suitable for use in these polyethylene glycol and/or methoxypolyethylene glycol containing solutions. Also indicated in the table is the general chemical description, manufacturer's name and major industrial uses. In addition, Table XVII shows the generally preferred amounts that can be used for each of these particular surfactants for window and glass cleaning applications.

TABLE XVII

PARTIAL LIST OF SUITABLE SYNTHETIC SURFACTANTS FOR USE WITH POLYETHYLENE OR METHOXYPOLYETHYLENE GLYCOL CONTAINING LIQUID CLEANING SOLUTIONS

| Surfactant Designation | Chemical Description | Manufacturer | Other Uses | *Generally Preferred Amounts (Referred to $H_2O$ by weight) |
|---|---|---|---|---|
| NEKAL BA-77 | sodium alkylnaphthelene sulfonate | GAF Corporation New York, New York | wetting dispensing penetrating and anti-static agent in paper and textile industry. Wetting of powdered insecticides | .008-.04% |
| NEKAL BX-78 | sodium alkylnaphthelene sulfonate | GAF Corporation New York, New York | wetting dispensing penetrating and anit-static agent in paper and textile industry. Wetting of powdered insecticides | .005-.03% |
| NEKAL WT-27 | sulfonated aliphatic polyester | GAF Corporation New York, New York | wetting, re-wetting and penetrating agent for paper and dyeing and glass cleaning | .001-.008% |
| ANTAROX BL-225 | modified linear aliphatic polyester | GAF Corporation New York, New York | textile wetting, metal cleaning rinse aid in commercial washing | .004-.027% |
| FLUORAD FC-95 | potassium per-fluoroalkyl sulfonate | 3-M Company St. Paul, Minnesota | wetting, pentrating and forming agents suitable for highly basic and acidic solutions in plating and anodizing | .001-.008% |
| FLUORAD FC-98 | potassium per-fluoroalkyl | 3-M Company St. Paul, Minnesota | wetting, penetrating and foaming agents suitable for highly basic and acidic solutions in | .0015-.01% |

TABLE XVII-continued

PARTIAL LIST OF SUITABLE SYNTHETIC SURFACTANTS FOR USE WITH POLYETHYLENE OR METHOXYPOLYETHYLENE GLYCOL CONTAINING LIQUID CLEANING SOLUTIONS

| Surfactant Designation | Chemical Description | Manufacturer | Other Uses | *Generally Preferred Amounts (Referred to $H_2O$ by weight) |
|---|---|---|---|---|
| | sulfonate | | plating and anodizing | |

*NOTE:
This amount has generally been found to be enough to improve wicking into absorbent toweling but small enough to avoid streaking or eventual clouding of window and mirror surfaces.

The list of surfactants in Table XVII is only intended to show a few specific choices that have been found to provide, by actual experimentation, satisfactory results. There are, of course, many others that will undoubtedly perform just as well, that can be selected from among the extremely large number of surfactant products now available on the market.

It should be pointed out that the use of a synthetic surfactant in these polyethylene and/or methoxypolyethylene glycol containing liquid cleaning solutions is by no means essential. The alcohol, for example, is in itself an excellent wetting and penetrating agent and appears to have no adverse affect on the oil and grease repelling properties of the polyethylene and/or methoxypolyethylene glycol component. With careful selection of type and amount, however, a surfactant as described above, and in Table XVII, can reduce the quantity of alcohol required for a given wicking rate and also appears in some instances to slightly accelerate transfer of oil and grease contamination into the toweling.

A wide molecular weight range of polyethylene and methoxypolyethylene glycols have been evaluated and found to be usable as the oil and grease repelling additive of the invention.

Table XVIII covers comparative tests made using a basic liquid cleaner formulation with polyethylene glycols ranging in molecular weight from about 400 to 20,000. Table XIX covers similar tests using methoxypolyethylene glycols with molecular weights ranging from 500 to 5,000. Table XX shows specific chemical and physical properties of the polyethylene and methoxypolyethylene glycol compounds used in all preceding tables including Tables XVIII and XIX. All of the compounds listed in Table XX are manufactured by Union Carbide Corporation, New York, N.Y., and are sold under the product name of CARBOWAX.

TABLE XVIII

PROPERTY VARIATIONS DUE TO USING OPTIMUM AMOUNTS OF POLYETHYLENE GLYCOL ADDITIVES OF DIFFERENT MOLECULAR WEIGHTS

BASIC FORMULATION: 90.8g $H_2O$, 2.35g Isopropanol, 4.05g 1-propanol, 0.364g $NH_4OH^{(o)}$, 0.011g Surfactant BA-77$^{(b)}$ TEST SURFACE: 24" × 18" Lubricity Test: Plate Glass; other test single strength mirror

| # | Polyethylene Glycol | Amount (grams) | Molecular Weight Range | Lubricity | Residual Contamination (Clean Glass) | Oil Removal Test (1 Drop Wesson Oil) |
|---|---|---|---|---|---|---|
| CW-15 | PEG-400$^{(m)}$ | 0.10 | 380–420 | Definitely more drag nearly dry and completely dry than CW-8, CW-3, CW-1 and CW-19. Chatters with back and forth motion of paper towel when surface becomes dry | None | Clean Surface |
| CW-8 | PEG-1540$^{(g)}$ | 0.20 | 1300–1600 | A little more drag nearly dry and completely dry than CW-3 | None | Clean Surface |
| CW-3 | PEG-4000$^{(e)}$ | 0.18 | 3000–3700 | Very slightly more drag nearly dry and completely dry than CW-1, but nearly the same | None | Clean Surface |
| CW-1 | PEG-6000$^{(h)}$ | 0.20 | 6000–7500 | Excellent- Low drag and smooth transition wet to dry stages | None | Clean Surface |
| CW-19 | PEGC-20M$^{(i)}$ | 0.26 | 18,000–19,000 | ~CW-1 Can't tell any difference with this particular formulation | None | Clean Surface |

$^{(e)}$Carbowax polyethylene glycol, 3000–3700 molecular weight, Mfg. by Union Carbide Corporation, New York, N.Y. Amount shown includes PEG-4000 + $H_2O$ 1:1 by weight $^{(g)}$Carbowax polyethylene glycol, 1300–1600 molecular weight, Mfg. by Union Carbide Corporation, New York, N.Y. Amount shown includes PEG-1540 + $H_2O$ 1:1 by weight $^{(m)}$Carbowax polyethylene glycol, 380–420 molecular weight, Mfg. by Union Carbide Corporation, New York, N.Y. Liquid at R/T, No $H_2O$ included in amounts shown above OTHER NOTES - See Table I

TABLE XIX

PROPERTY VARIATIONS DUE TO USING OPTIMUM AMOUNTS OF METHOXYPOLYETHYLENE GLYCOL ADDITIVES OF DIFFERENT MOLECULAR WEIGHTS

BASIC FORMULATION: 90.8g $H_2O$
2.35g Isopropanol
4.05g l-propanol
0.364g$NH_4OH^{(o)}$
0.011g Surfactant BA-77$^{(b)}$
-- MPEG-see below TEST SURFACE: 24" ×18" Lubricity Test:Plate Glass other tests single strength mirror

| # | Methoxy - Polyethylene Glycol | Amount (grams) | Molecular Weight Range | Lubricity | Residual Contamination (Clean Glass) | Oil Removal Test (1 Drop Wesson$^{(R)}$Oil) |
|---|---|---|---|---|---|---|
| CX-7 | MPEG-550$^{(d)}$ | 0.06 | 525–575 | Definitely more drag than CX-1 nearly dry or completely dry, slightly sticky feeling and chattering when rubbing back and forth with paper towel when dry | None | Clean Surface |
| CX-3 | MPEG-2M$^{(n)}$ | 0.16 | 1900 | ~CX-1 when nearly dry but slightly more drag completely dry | None | Clean Surface |
| CX-1 | MPEG-5K$^{(f)}$ | 0.20 | 5000 | Excellent-very low drag and excellent transition, very slightly less drag than CW-1 (Table XVIII) | None | Clean Surface |

$^{(d)}$Carbowax methoxypolyethylene glycol, 525–575 molecular weight, Mfg. by Union Carbide Corporation, New York, N.Y. Liquid at R/T, no $H_2O$ included in amounts shown above
OTHER NOTES - See Table I

TABLE XX

CHEMICAL AND PHYSICAL PROPERTIES OF SELECTED POLYETHYLENE AND METHOXYPOLYETHYLENE GLYCOLS

| Type | Molecular Weight Range | Apparent Specific Gravity (20/20° C.) | Freezing Range | $H_2O$ Solubility % by Weight | Viscosity Centistoke at 210° F. | Comparative Hygroscopicity (Glycerin = 100) |
|---|---|---|---|---|---|---|
| Carbowax Polyethylene Glycol 400 | 380–420 | 1.1281 | 4–8 C. | 100% | 7.3 | 60 |
| Carbowax Polyethylene Glycol 600 | 570–630 | 1.1279 | 20–25 C. | 100% | 10.5 | 50 |
| Carbowax Polyethylene Glycol 1000 | 950–1050 | 1.101 | 37–40 C. | ~70% | 17.4 | 35 |
| Carbowax Polyethylene Glycol 1500 | 500–600 | 1.151 | 38–41 C. | 73% | 13–18 | 35 |
| Carbowax Polyethylene Glycol 1540 | 1300–1600 | 1.0910 | 43–46 C. | 70% | 25–32 | 30 |
| Carbowax Polyethylene Glycol 4000 | 3000–3700 | 1.204 | 53–56 C. | 62% | 80–95 | — |
| Carbowax Polyethylene Glycol 6000 | 6000–7500 | 1.207 | 60–63 C. | ~50% | 700–900 | — |
| Carbowax Polyethylene Glycol 20,000 linear | 18000–19000 | 1.215 | 56 C. | — | 8,179 | — |
| Polyethylene Glycol Compound 20M | 15000 approx. | 1.207 | 50–55 C. | 50% | 14,500 | — |
| Carbowax Methoxypolyethylene Glycol 350 | 335–365 | 1.094 | −5 to +10 C. | 100% | 4.1 | — |
| Carbowax Methoxypolyethylene Glycol 550 | 525–575 | 1.089 (40/20° C.) | 15–25 C. | 100% | 7.5 | — |
| Carbowax Methoxypolyethylene Glycol 750 | 715–785 | 1.094 (40/20° C.) | 27–33 C. | 100% | 10.5 | — |
| Carbowax Methoxypolyethylene Glycol 2000 | 1900 | — | 51.9 C. | — | 54.6 | — |
| Carbowax Methoxypolyethylene Glycol 5000 | 5000 | — | 59.2 C. | — | 61.3 | — |

NOTE:
Data taken from Union Carbide "1975–1976 Chemical and Plastics Physical Properties" Publications.

Referring to Tables XVIII and XIX it can be seen that all of the molecular weight ranges tested provided excellent oil and grease repulsion regardless of whether the additive was polyethylene or methoxypolyethylene glycol. Also, when used in the preferred amounts, there was found to be no problem with residual streaking on the glass surface after wiping to the dry condition.

The primary differences between these polyethylene and methoxypolyethylene glycol additives is seen to occur in the degree of imparted lubricity during the time the liquid cleaner is being wiped from the surface with absorbent toweling. The data in this respect, shows that the superior choices are those of the higher molecular weight ranges that form hard, waxy, non-hygrosiopic solids at room temperature.

Those that are liquids at room temperature present more drag when nearly dry or completely dry than the former. Formulation CW-8, containing polyethylene glycol 1540, in Table XVIII is quite a soft waxy material at room temperature and occupies a relatively intermediate position from the lubricity standpoint.

Overall, there also appears to be little discernible advantage between the polyethylene and methoxypolyethylene glycols in similar molecular weight ranges.

The amount of each molecular weight grade of polyethylene or methoxypolyethylene glycol used in the examples of Tables XVIII and XIX were determined from prior tests to be the amount that maximized lubricity when applied to a plate glass surface and wiped dry with a paper towel. In every case, it was found that using higher or lower amounts of a given glycol would cause an increase in the overall frictional properties when the surface of the glass has been wiped to the nearly dry stage; however, when wiped to the completely dry stage, exceeding the optimum amount does not show any particular change in the drag properties.

By way of example, Table XXI shows the relative effects on lubricity by varying the amount of polyethylene glycol CARBOWAX 400 in a given formulation. Tables XXII and XXIII cover the same type of data for polyethylene glycol CARBOWAX 20,000 linear and methoxypolyethylene glycol CARBOWAX 5,000, respectively. Data for the other molecular weight grades has not been included because the overall effect is essentially the same and the optimized values are found in Tables XVIII and XIX.

TABLE XXI

EFFECT OF VARYING AMOUNTS OF CARBOWAX POLYETHYLENE GLYCOL - 400 ADDITIVE IN RESPECT TO OVERALL LUBRICITY

BASIC FORMULATION: 90.8g $H_2O$
2.35 Isopropanol
4.05 l-propanol
0.364 $NH_4OH^{(o)}$
0.011 Surfactant BA-77$^{(b)}$
—PEG-400 see below TEST SURFACE: 24" × 18" Plate Glass

| # | Polyethylene Glycol | Amount (grams) | Lubricity |
|---|---|---|---|
| CW-14 | PEG-400$^{(m)}$ | 0.068 | Definitely more drag nearly dry and completely dry than CW-15 |
| CW-15 | PEG-400 | 0.102 | Low Drag - Definitely less drag nearly dry and better transition wet to dry than CW-14 or CW-15 When completely dry tends to squeak slightly when surface is rubbed back and forth with paper towel |
| CW-16 | PEG-400 | 0.136 | A little more drag nearly dry than CW-15 and ~same when dry. More squeaking or chattering wet than CW-15 but ~same dry. |

NOTES
See Tables I and XVIII

TABLE XXII

EFFECT OF VARYING AMOUNTS OF CARBOWAX POLYETHYLENE GLYCOL 20,000 LINEAR ADDITIVE IN RESPECT TO OVERALL LUBRICITY

BASIC FORMULATION: 90.85g $H_2O$
6.10 Isopropanol
0.16 l-propanol
0.104 $NH_4OH^{(p)}$
0.10 $NH_4HCO_3$
0.012 Surfactant BX-78$^{(c)}$
—PEG-20K linear$^{(j)}$
see below TEST SURFACE: 24" × 18" Plate Glass

| # | Polyethylene Glycol | Amount (grams) | Lubricity |
|---|---|---|---|
| JJ-1 | PEG-20K$^{(j)}$ linear | 0.162 | Definitely not enough PEG-20k linear material - fair amount of drag nearly dry and completely dry |
| JJ-2 | PEG-20K$^{(j)}$ linear | 0.216 | Considerably less drag than JJ-1 nearly dry but slightly more drag than JJ-6. ~JJ-3 Completely dry. |
| JJ-6 | PEG-20K$^{(j)}$ linear | 0.243 | Very slightly less drag than JJ-2 nearly dry and very slightly more drag than JJ-3 nearly dry ~ JJ-3 completely dry |
| JJ-3 | PEG-20K$^{(j)}$ linear | 0.270 | Excellent-Very low overall drag and excellent transition wet to completely dry. |
| JJ-5 | PEG-20K$^{(j)}$ linear | 0.297 | ~JJ-6 |
| JJ-4 | PEG-20K$^{(j)}$ linear | 0.324 | ~JJ-1 Nearly dry but ~JJ-3 completely dry. |

NOTES
See Table I and XIII

TABLE XXIII

EFFECT OF VARYING AMOUNTS OF CARBOWAX METHOXY-POLYETHYLENE GLYCOL 5000 ADDITIVE IN RESPECT TO OVERALL LUBRICITY

BASIC FORMULATION: 90.85g $H_2O$
6.10 Isopropanol
0.16 l-propanol
0.104 $NH_4OH^{(p)}$
0.10 $NH_4HCO_3$
0.012 Surfactant BX-78$^{(c)}$
—MPEG-5K$^{(f)}$see below TEST SURFACE: 24" × 18" Plate Glass

| # | Methoxy-Polyethylene Glycol | Amount (grams) | Lubricity |
|---|---|---|---|
| JK-3 | MPEG-5K$^{(f)}$ | 0.15 | Not enough MPEG-5 - Fair amount of drag both nearly dry and when completely dry |
| JK-3½ | MPEG-5K$^{(f)}$ | 0.175 | Definitely less drag than JK-3 nearly dry. But slightly more drag than JK-4 nearly dry. ~JK-4 completely dry |
| JK-4 | MPEG-5K$^{(f)}$ | 0.20 | Excellent-Lowest overall drag of series, excellent transition wet to completely dry |
| JK-4½ | MPEG-5K$^{(f)}$ | 0.225 | ~JK-3½ Can't tell any difference |
| JK-5 | MPEG-5K$^{(f)}$ | 0.25 | Considerably more drag than JK-4, nearly dry but ~ JK-4 when dry |
| WINDEX | — | — | ~ JK-4 and others when wet but more drag than JK-3 nearly dry and considerably more drag when dry. |

NOTES
See Table I

A variety of tests have been conducted where more than one molecular weight grade of polyethylene or methoxypolyethylene glycol have been used in the same formulation. Also, combinations of these compounds in differing molecular weight grades have been similarly tried. While in many cases excellent results have been obtained, no particular advantage could be found in such combinations either from the lubricity, oil removal or anti-contamination standpoints.

The optimized amounts of the polyethylene and methoxypolyethylene glycols for a given molecular weight grade were found to remain fairly well fixed, at least for the cleaning of window and mirror surfaces, in spite of nominal variations in amount of ammonium hydroxide, or nominal amounts or types of inorganic or organic lubricants, surfactants, or grease cutters; however, drastically increasing the amount of alcohol in a particular formulation will necessitate a reduction in the amount of the polyethylene or methoxypolyethylene glycol required for optimum lubricity characteristics. This indicates that the water/glycol relationship is the important relationship and not simply the total liquid to polyethylene or methoxypolyethylene glycol ratio.

Some high alcohol content formulations are shown in Table XXIV. These have been designed for use at temperatures as low as the order of −40° F. without freezing, and utilize isopropanol, methanol, and in one formulation a combination of isopropanol and 1-propanol. Because of the drastic change in alcohol content some control samples were also included for reference purposes.

TABLE XXIV

HIGH ALCOHOL CONTENT FORMULATIONS FOR LOW TEMPERATURE USE (~ −40F.)

BASIC FORMULATION- See Below

TEST SURFACE: 24" × 18" Lubricity Test: Plate Glass; other tests single strength mirror

| # | Formulation | Amount (grams) | Lubricity | Residual Contamination (Clean Glass) | Oil Removal Test (1 Drop 'WESSON Oil) |
|---|---|---|---|---|---|
| CM-2 | $H_2O$ | 85.7 | ~ CN-2 | None | Very Clean |
| | Isopropanol | 4.0 | a little less drag than CN-1 and | | |
| | 1-propanol | 6.3 | a little more drag than CN-3 when | | |
| | 2,3-butanediol | 0.026 | nearly dry. same as CN-1 and | | |
| | MPEG-5K$^{(f)}$ | 0.20 | CN-3 when dry | | |
| CN-1 | $H_2O$ | 53.0 | A little more drag than CN-2 | Very faint | No obvious oil |
| | Isopropanol | 36.0 | nearly dry but ~ same dry. | streaks - | streaks, but MPEG-5K |
| | 2,3-butanediol | 0.026 | | believed to be | as faint residual |
| | MPEG-5K$^{(f)}$ | 0.20 | | excess MPEG-5K | streaks still present |
| CN-2 | $H_2O$ | 53.0 | ~ CM-2 Can't tell any | None | Very Clean |
| | Isopropanol | 36.0 | difference | | |
| | 2,3-butanediol | 0.013 | | | |
| | MPEG-5K$^{(f)}$ | 0.10 | | | |
| CN-3 | $H_2O$ | 53.0 | Very slightly less drag than | None | Very Clean |
| | Isopropanol | 14.5 | CM-2 or CN-2 when nearly dry | | |
| | 1-propanol | 24.75 | ~ same when dry | | |
| | 23-butanediol | 0.013 | | | |
| | MPEG-5K$^{(f)}$ | 0.10 | | | |
| CN-4 | $H_2O$ | 49.1 | Definitely more drag nearly dry | None | Very Clean |
| | Methanol | 39.4 | than CN-2 ~CN-2 completely dry. | | |
| | 2,3-butanediol | 0.013 | Not as smooth a transition wet | | |
| | MPEG-5K$^{(f)}$ | 0.10 | to dry as CN-2 | | |
| CN-0 | $H_2O$ | 53.0 | Very great drag both nearly dry | None | Large amount oil |
| | Isopropanol | 36.0 | and completely dry OK wet. Very | | streaking all over |

TABLE XXIV-continued

| # | Formulation | Amount (grams) | Lubricity | TEST SURFACE: Residual Contamination (Clean Glass) | BASIC FORMULATION- See Below 24" × 18" Lubricity Test: Plate Glass; other tests single strength mirror Oil Removal Test (1 Drop 'WESSON Oil) |
|---|---|---|---|---|---|
| HIGH ALCOHOL CONTENT FORMULATIONS FOR LOW TEMPERATURE USE (~ −40F.) | | | | | |
| | | | much more drag than CN-2 or CN-1 nearly dry or completely dry. Very poor transition wet to dry | | surface of glass |
| CN-5 | $H_2O$ | 49.1 | ~ CN-0 | None | ~ CN-0 |
| | Methanol | 39.4 | Very much more drag than CN-4 nearly dry and when completely dry | | Large amount oil streaking all over |

Referring to Table XXIV, Sample #CM-2 is a normal, low alcohol content formulation containing a mixture of isopropanol and 1-propanol. As will be noted this sample showed the expected excellent results in terms of lubricity, residual streaking and oil removal properties. Sample #CN-1 is very similar to #CM-2 except that it contains a very high percentage of isopropanol. The data shows that this caused a little higher drag than #CM-2 but more significantly caused residual streaking that was just beginning to show up on the glass surface after wiping to the dry stage. This streaking was undoubtedly due to the excess methoxypolyethylene glycol that was now present in the formulation since the water content had been very considerably reduced due to the high alcohol addition.

This latter problem is seen to have been completely eliminated in sample #CN-2 where the only change from #CN-1 has been to cut the amounts of the organic lubricant and the methoxypolyethylene glycol in half. The low drag characteristic has also been restored to that of the #CM-2 formulation with the lower alcohol content. Sample #CN-3 was also run where the higher alcohol content was composed of both isopropanol and 1-propanol and included the reduced methoxypolyethylene glycol amount. Again, excellent results were obtained.

Sample #CN-4 is very similar to #CN-2 except that methanol has been substituted for isopropanol. As can be seen in Table XXIV, the methanol degraded the overall lubricity of the formulation over that of using isopropanol. This confirms the data obtained earlier in Table II, where smaller, more normal amounts of methanol were compared with isopropanol on a lubricity basis.

Formulations #CN-0 and #CN-4 containing isopropanol and methanol, respectively, but having neither polyethylene or methoxypolyethylene glycol as an additive, were included to confirm that is spite of the high alcohol content the overall lubricity and excellent oil contamination removal properties are now absent.

High alcohol content formulations, such as those just described, are suitable for use in the liquid storage reservoirs for automobile and truck window cleaner systems where winter freezing can be a problem. In applications of this type, where the wiping operation is not being done by hand, a formulation possessing maximized lubricity characteristics may not be important. For example, formulation #CN-4 of Table XXIV containing methanol, has been found to provide excellent cleaning results in just such an application. In uses of this type, for example #CN-4 of Table XXIV, the methanol is usually less costly as well as providing a lower freezing point for the amount added than the other higher boiling point alcohols.

In summarizing, it can be stated that all of the polyethylene and methoxypolyethylene glycol molecular weight grades referred to in the tables of this application have been found to provide liquid cleaning solutions possessing excellent lubricity and extremely good oil and grease removal properties.

A preferred grouping of these polyethylene and methoxypolyethylene glycol compounds can be made by selecting the higher molecular weight grades. Such a group could consist of the polyethylene glycol CARBOWAX 4,000, 6,000, 20,000 linear, polyethylene glycol compound 20M and methoxypolyethylene glycol CARBOWAX 2,000, 5,000. Other and higher molecular weight compounds that are non-hygroscopic, if available, would appear to be satisfactory.

It should be pointed out that the CARBOWAX polyethylene glycol compound 20M material manufactured by Union Carbide Corporation is reported to be a cross-linked 6,000 molecular weight polyethylene glycol. In this respect it differs from the linear, long chain molecular structure of the other polyethylene and methoxypolyethylene glycols.

Referring to Table XX it can also be seen that the polyethylene glycol 20M material has a considerably higher viscosity value than any of the other grades.

Tests have been made with the liquid cleaning solutions of this invention in order to optimize the liquid flow on the surface being cleaned. This property is, of course, affected by the alcohol content and the particular type and amount of surfactant used. It has also been found that the particular grade of polyethylene glycol or methoxypolyethylene glycol employed in the formulation can have a considerable effect on this property.

For example, referring to Table XXV, formulation JX-13 containing CARBOWAX polyethylene glycol 20,000 linear material was found to provide noticeablly better wetting of a polished LUCITE surface than formulation JX-14 containing CARBOWAX polyethylene glycol 6,000 or formulation JX-11 containing methoxypolyethylene glycol 5,000. Furthermore, the polyethylene glycol compound 20M grade used in formulation JX-10 reduced the surface tension to an even greater extent under the same test conditions.

TABLE XXV

REPRESENTATIVE FORMULATIONS FOR WINDOW, MIRROR, GLASS AND CHROME CLEANERS FOR GENERAL HOUSEHOLD USE

| # | $H_2O$ and Alcohol | Amount (grams) | Grease Cutting Aids | Amount (grams) | Organic Lubricant | Amount (grams) | Surfactant | Amount (grams) | PEG or MPEG | Amount (grams) |
|---|---|---|---|---|---|---|---|---|---|---|
| JX-10 | $H_2O$ | 86.75 | $NH_4OH^{(p)}$ | 0.104 | None | — | BX-78[c] | 0.012 | PEGC-20M[i] | 0.26 |
| | Iso-propanol | 9.45 | $NH_4HCO_3$ | 0.08 | | | | | | |
| | 1-propanol | 0.344 | $K_2B_4O_7 \cdot 4H_2O$ | 0.10 | | | | | | |
| JX-11 | $H_2O$ | 86.75 | $NH_4OH^{(p)}$ | 0.104 | None | — | BX-78[c] | 0.012 | MPEG-5K[j] | 0.20 |
| | Iso-propanol | 7.45 | $NH_4HCO_3$ | 0.08 | | | | | | |
| | 1-propanol | 0.244 | $K_2B_4O_7 \cdot 4H_2O$ | 0.10 | | | | | | |
| JX-12 | $H_2O$ | 86.75 | $NH_4HCO_3$ | 0.08 | None | — | BX-78[c] | 0.012 | PEGC-20M[i] | 0.26 |
| | Iso-propanol | 9.45 | $KBO_2 \cdot \times H_2O$ | 0.1 | | | | | | |
| | 1-propanol | 0.244 | | | | | | | | |
| JX-13 | $H_2O$ | 86.75 | $NH_4OH^{(p)}$ | 0.104 | None | — | BX-78[c] | 0.012 | PEG-20,000[j] linear | 0.27 |
| | Is-propanol | 9.45 | $NH_4HCO_3$ | 0.08 | | | | | | |
| | 1-propanol | 0.244 | $K_2B_4O_7 \cdot 4H_2O$ | 0.10 | | | | | | |
| JX-14 | $H_2O$ | 86.75 | $NH_4OH^{(p)}$ | 0.104 | none | — | BX-78[c] | 0.012 | PEG-6000[h] | 0.20 |
| | Iso-propanol | 9.45 | $NH_4HCO_3$ | 0.08 | | | | | | |
| | 1-propanol | 0.244 | $K_2B_4O_7 \cdot 4H_2O$ | 0.10 | | | | | | |
| GA-8 | $H_2O$ | 90.80 | $NH_4OH^{(p)}$ | 0.260 | 2,3 butanediol | 0.026 | BA-77[b] | .011 | MPEG-5K[j] | 0.20 |
| | Iso-propanol | 2.35 | $NH_4HCO_3$ | 0.075 | | | | | | |
| | 1-propanol | 4.06 | | | | | | | | |
| GA-10 | $H_2O$ | 83.50 | $NH_4OH^{(p)}$ | 0.26 | 3-Methoxy, 1-butanol | 0.123 | BA-77[b] | .011 | PEG-6000[h] | 0.20 |
| | Iso-propanol | 4.65 | | | | | | | | |
| | 1-propanol | 6.50 | | | | | | | | |
| JY-37 | $H_2O$ | 88.60 | $NH_4OH^{(p)}$ | 0.156 | none | — | BX-78[c] | 0.012 | PEGC-20M[i] | 0.26 |
| | Iso-propanol | 7.80 | $(NH_4)_2CO_3$ | 0.10 | | | | | | |
| | 1-propanol | 0.201 | | | | | | | | |
| KB-18 | $H_2O$ | 86.75 | $NH_4OH^{(p)}$ | 0.21 | 1,3 butanediol | 0.31 | BL-225[a] | 0.013 | MPEG-5K[j] | 0.20 |
| | Iso-propanol | 9.45 | | | | | | | | |
| | 1-propanol | 0.244 | | | | | | | | |
| JY-34 | $H_2O$ | 85.90 | $NH_4OH^{(p)}$ | 0.156 | none | — | BX-78[c] | 0.012 | MPEG-5K[j] | 0.20 |
| | Iso-propanol | 10.00 | $Na_3PO_4 \cdot 12H_2O$ | 0.075 | | | | | | |
| | 1-propanol | 0.258 | $NH_4HCO_3$ | 0.08 | | | | | | |
| | | 0.258 | | | | | | | | |
| KB-8 | $H_2O$ | 86.75 | $NH_4OH^{(p)}$ | 0.156 | 2,3-butanediol | 0.039 | BX-78[c] | 0.012 | PEGC-20M[i] | 0.26 |
| | Iso-propanol | 9.45 | | | | | | | | |
| | 1-propanol | 0.244 | | | | | | | | |
| KB-11 | $H_2O$ | 86.75 | $NH_4OH^{(p)}$ | 0.156 | 2,3-butanediol | 0.039 | BX-78[c] | 0.012 | MPEG-5K[j] | 0.2 |
| | Iso-propanol | 9.45 | | | | | | | | |
| | 1-propanol | 0.244 | | | | | | | | |
| KB-14 | $H_2O$ | 86.75 | $NH_4OH^{(p)}$ | 0.156 | 2,3-butanediol | 0.026 | BX-78[c] | 0.012 | MPEG-5K[j] | 0.2 |
| | Iso-propanol | 9.45 | $NH_4HCO_3$ | 0.08 | | | | | | |
| | 1-propanol | 0.244 | $K_2B_4O_7 \cdot 4H_2O$ | 0.1 | | | | | | |
| KB-15 | $H_2O$ | 86.75 | $NH_4OH^{(p)}$ | 0.11 | 2,3-butanediol | 0.026 | BX-78[c] | 0.012 | MPEG-5K[j] | 0.2 |
| | Is-propanol | 9.45 | $NH_4HCO_3$ | 0.08 | | | | | | |
| | 1-propanol | 0.244 | $KBO_2 \cdot \times H_2O$ | 0.1 | | | | | | |

[a]ANTAROX surfactant, modified linearaliphatic polyether, Mfg. by GAF Corporation, New York, N.Y.
OTHER NOTES - See Tables I and XIII Minimizing the surface tension may be of particular importance when the liquid cleaning solutions are to be used on oil and grease contaminated or other hard to wet surfaces.

Table XXV lists a number of examples of liquid window, mirror and glass cleaners for general household use. All of these formulations have been found to provide exceptionally good transfer of oil, grease and other contaminants from the glass surface to the absorbent toweling. They have all shown very low frictional resistance between the toweling and the glass surface during the drying operation. They have also shown excellent resistance to re-contamination by airborne hydrocarbons. This property will be described later.

While the main emphasis in this application has been for the use of this invention for the cleaning of windows, mirrors and glass surfaces, it has been found that many of the formulations, including those in Table XXV, have other important uses. For example, these formulations have been found to be very effective for polishing and cleaning hard chrome plated objects, stainless steel and enameled surfaces, glazed ceramics, FORMICA countertops, a variety of plastics, and many other smooth surfaces.

The same oil and grease transferring properties desired for cleaning windows and mirrors are often of equal importance in these other cleaning areas. Chrome plated faucets and fixtures are extremely easy to clean to a high luster with the polyethylene or methoxypolyethylene glycol containing formulations without leaving oil, grease or soap streaks. Brushed stainless steel counter and stove tops can be easily wiped clean of grease splatters without re-distributing the contaminating material as visible streaks.

For specialized cleaning jobs of the type just described, and where the extreme optical clarity required for cleaning window and mirror surfaces may not be necessary, larger amounts of polyethylene or methoxypolyethylene glycol additives can often be tolerated or may even be advantageous.

Table XXVI shows formulations of this type designed for cleaning FORMICA table and countertops, and the like, where it is desired to not only efficiently remove oil, grease and other surface contamination but to also leave a visible wax sheen on the cleaned surface. As can be seen from the table, the amounts of the methoxypolyethylene and polyethylene glycols used in formulations LD-3, LD-4, LD-5 and LD-7 range from twice to slightly more than three times the amounts that would be used for optimum lubricity and optical clarity in a comparable formulation for cleaning mirrors and windows.

TABLE XXVI

HIGH POLYETHYLENE OR METHOXYPOLYETHYLENE CONTAINING FORMULATIONS FOR SPECIAL CLEANING APPLICATIONS

| # | $H_2O$ and Alcohol | Amount (grams) | Grease Cutting Aids | Amount (grams) | Organic Lubricant | Amount (grams) | Surfactant | Amount (grams) | PEG or MPEG | Amount (grams) |
|---|---|---|---|---|---|---|---|---|---|---|
| LD3 | $H_2O$ | 90.80 | $(NH_4)_2CO_3$ | 0.1g | | | | | | |
| LD3 | Isopropanol | 2.35 | $KBO_2 . x H_2O$ | 0.1g | none | — | BA-77[b] | .028 | MPEG-5K[f] | 0.40 |
| | 1-propanol | 4.05 | | | | | | | | |
| LD-4 | $H_3O$ | 86.75 | $NH_4HCO_3$ | 0.1g | | | | | | |
| | Isopropanol | 9.45 | $Na_3C_6H_5O_7 . 2H_2O$ | 0.3g | none | — | BX-78[c] | .024 | PEGC-20M[i] | 0.52 |
| | 1-propanol | 0.244 | | | | | | | | |
| LD-7 | $H_2O$ | 86.60 | $NH_4HCO_3$ | 0.1g | | | | | PEG- | |
| | Isopropanol | 7.80 | $Na_3PO_4$ | 0.1g | none | — | FC-98[g] | .02 | 20,000[j] | 0.81 |
| | 1-propanol | 0.203 | | | | | | | linear | |
| LD-5 | $H_2O$ | 88.60 | $NH_4OH$[p] | .364 | | | | | | |
| | Isopropanol | 7.80 | | | 2,3 | 0.078 | BX-78 | .024 | PEGC- | 0.52 |
| | 1-propanol | 0.203 | | | buta- | | | | 20M[i] | |
| | | | | | nediol | | | | | |

[g]FLUORAD surfactant-potassium perfluoroalkyl sulfonate, Mfg. by 3-M Co., St. Paul, Minnesota
OTHER NOTES - See Tables I and XIII It will also be noted that greater amounts of added grease-cutting aids have been used in some of these specialized cleaners. Formulation LD-4, for example, uses sodium citrate in an amount that would cause a cloudy appearance on a glass surface under high humidity conditions; however, a slight contamination of this type will be unnoticed in the intended application and consequently the excellent oil and grease-cutting properties found to be present with the addition of the citrate can be exploited.

One of the important advantages of using the polyethylene or methoxypolyethylene glycol additive in the window and mirror cleaning solutions as practiced in this invention, is their ability to maintain the glass surface in a clean condition.

More specifically, the residual layer of the polyethylene or methoxypolyethylene glycol that is left on the surface following the cleaning and drying operation has been found to be extremely resistant to re-contamination by airborne hydrocarbons.

This unique property is due to a combination of the inherent oil and grease repelling properties of the polyethylene or methoxypolyethylene glycol compounds coupled with an extremely low evaporation rate. In this latter respect, it has been found that the lower molecular weight CARBOWAX polyethylene glycol 400 and methoxypolyethylene glycol 550 grades, when spread as a thin layer on a glass surface, where still visible after 60 days (at which time the test was discontinued). Thin films of the higher molecular weight materials appear to be extremely long lasting.

A convenient means of testing this anti-contaminating property has involved cleaning the inside front and rear windows of a Karmann Ghia automobile. A variety of formulations of this invention have been directly compared in this manner with a number of commercial liquid window cleaning products. These are listed in Table XXVII.

TABLE XXVII

FORMULATIONS USED IN AIRBORNE HYDROCARBON CONTAMINATION COMPARISON TESTS ON AUTOMOBILE INTERIOR WINDOW SURFACES

TEST SURFACE: Inside Karmann Ghia Front Windshield & Rear Window

| # | Commercial Cleaner or $H_2O$ and Alcohol | Amount (grams) | Grease Cutting Aids and/or Lubricant | Amount (grams) | Sur-factant | Amount (grams) | PEG or MPEG Additive | Amount (grams) | Test Duration and Surface Condition |
|---|---|---|---|---|---|---|---|---|---|
| W-1 | WINDEX | — | — | — | — | — | — | — | 3-14 days Visually cloudy surface |
| G-P | GLASS PLUS | — | — | — | — | — | — | — | ~W-1 |
| A | AJAX | — | — | — | — | — | — | — | ~W-1 |
| E-O | EASY OFF | — | — | — | — | — | — | — | ~W-1 |
| S | SPARKLE | — | — | — | — | — | — | — | ~W-1 |
| BA | BON-AMI | — | — | — | — | — | — | — | 11 Days Visually cloudy surface |
| W-2 | WINDEX | — | — | — | — | — | — | — | 3-8 Weeks, Severe surface clouding, vision impaired |
| GP-2 | GLASS PLUS | — | — | — | — | — | — | — | 3-6 Weeks W-2 |
| 1 | $H_2O$ | 78.65 | — | — | BA-77[b] | 0.01 | PEG-6K[h] | 0.15 | 3 Weeks, Still clear no visual impairment |
| | Isopropanol | 15.65 | | | | | | | |
| B | $H_2O$ | 81.1 | — | — | BA-77[b] | 0.006 | PEG-6K[h] | 0.2 | 8 Days, Very Clear |
| | Isopropanol | 13.69 | | | | | | | |
| D | $H_2O$ | 83.75 | — | — | BA-77[b] | 0.006 | PEG-6K[h] | 0.35 | 10 Days ~B |
| | Isopropanol | 11.75 | | | | | | | |
| E | $H_2O$ | 83.75 | $NH_4OH$[o] | 0.36 | BA-77[b] | 0.006 | PEG-6K[h] | 0.35 | 11 Days ~B |
| | Isopropanol | 11.75 | | | | | | | |
| F | $H_2O$ | 92.32 | $NH_4OH$[o] | 0.21 | BA-77[b] | 0.006 | MPEG-5K[f] | 0.2 | 9 Days ~B |
| | Isopropanol butyl cellosolve | 2.80 | | | | | | | |
| O | $H_2O$ | 88.65 | $NA_4P_2O_7 \cdot 10H_2O$ | 0.05 | FC-95[q] | 0.004 | MPEG-5K[f] | 0.2 | 3 Days ~B |
| | Isopropanol | 8.17 | $Na_2CO_3 \cdot 10H_2O$ | 0.1 | | | | | |
| | | | $NH_4OH$[o] | 0.26 | | | | | |
| L | $H_2O$ | 88.65 | $Na_2B_4O_7 \cdot 10H_2O$ | 0.2 | FC-95[q] | 0.-04 | MPEG-5K[f] | 0.2 | 3 Days ~B |
| | Isopropanol | 8.17 | $Na_2CO_3 \cdot 10H_2O$ | 0.1 | | | | | |
| J | $H_2O$ | 88.65 | | | | | | | |
| | Isopropanol | 8.17 | | | BL-225[a] | .014 | | | |
| | 3-Methoxy, 1-Butanol | 0.16 | $NH_4OH$[o] | 0.26 | FC-98[q] | .005 | MPEG-5K[f] | 0.2 | 6 Days ~B |
| 95 | $H_2O$ | 83.65 | | | | | | | |
| | Isopropanol | 5.84 | $NH_4OH$[o] | 0.36 | BA-77[b] | 0.006 | MPEG-5K[f] | 0.2 | 3 Weeks ~1 |
| | 1-propanol | 6.09 | | | | | | | |
| AK | $H_2O$ | 83.65 | | | | | | | 8 Weeks some surface deposit noticeable by rubbing finger on glass but no real visual impairment |
| | Isopropanol | 5.84 | | | | | | | |
| | 1-propanol | 6.09 | $NH_4OH$[o] | 0.36 | BA-77[b] | 0.006 | MPEG-5K[f] | 0.2 | |
| | 3 Methoxy, 1-butanol | 0.16 | | | | | | | |
| GA-11 | $H_2O$ | 85.7 | | | | | | | |
| | Isopropanol | 4.0 | $NH_4OH$[p] | 0.26 | | | | | |
| | 1-propanol | 6.3 | | | BA-77[b] | 0.011 | PEG-20K[j] linear | 0.27 | 2 Weeks ~1 |
| | 2,3-butanediol | 0.026 | $NH_4HCO_3$ | 0.075 | | | | | |
| JR-12 | $H_2O$ | 85.9 | $NH_4OH$[p] | 0.21 | | | | | |
| | Isopropanol | 10.0 | $NH_4HCO_3$ | 0.08 | BX-78[c] | 0.012 | PEGC-20M[i] | 0.26 | 2 Weeks ~1 |
| | 1-propanol | 0.26 | $KBO_2 \cdot x\ H_2O$ | 0.1 | | | | | |
| JX-10 | $H_2O$ | 86.75 | $NH_4OH$[p] | 0.104 | | | | | |
| | Isopropanol | 9.45 | $NH_4HCO_3$ | 0.08 | BX-78[c] | 0.012 | PEGC-20M[i] | 0.26 | 6 Weeks ~AK |
| | 1-propanol | 0.244 | $K_2B_4O_7 \cdot 4H_2O$ | 0.10 | | | | | |
| KB-14 | $H_2O$ | 86.75 | $NH_4OH$[p] | 0.156 | | | | | |
| | Isopropanol | 9.45 | $NH_4HCO_3$ | 0.08 | | | | | |
| | 1-propanol | 0.244 | $K_2B_4O_7 \cdot 4H_2O$ | 0.1 | BX-78[c] | 0.012 | MPEG-5K[f] | 0.2 | 6 Weeks ~AK |
| | 2,3 butanediol | 0.026 | | | | | | | |

NOTES
See Tables I, XIII, XXV and XXVI

The testing procedure consisted simply of cleaning half of the window (such as the right side) with the commercial product and the other half with a polyethylene or methoxypolyethylene glycol containing formulation. The comparison was made by noticing differences in clarity due to "fogging" caused by hydrocarbon build-up on the inside window surfaces.

The results of these tests were found to be essentially identical in every instance. Namely, the half of the window cleaned with the commercial product began to show very definite signs of clouding or "fogging" in at least a weak's time. In hot weather this often occurred in as little as two days' time. In some instances, the test duration was five to eight weeks in length, at which point the contaminating film build-up on the half cleaned with the commercial window cleaning product was often found to be seriously affecting vision, especially at night with oncoming headlights. In all these direct comparison tests as can be seen in Table XXVII, the half cleaned with one of the polyethylene or methoxypolyethylene glycol containing formulations was always found to be remarkably free from any clouding effects or visual impairment.

These tests were conducted mainly during warm to hot weather and at an elevation of slightly over 7,000 feet. It is suspected that plasticizer outgasing from the interior of the automobile in addition to airborne oil and smoke particles was contributing to the rapid contamination rates noted with the commercial cleaners; however, the test data was felt to be relative in nature and is believed to correctly show the inherent contamination repelling nature of the formulations of this invention.

In this application, all percentages are by weight unless otherwise specified. Deionized water was used in the majority of the formulations included in this application. Tap water of reasonable softness has also been used in many instances, however, with no noticeable degradation of overall properties.

In my copending U.S. Patent Application, Ser. No. 885,311, now U.S. Pat. No. 4,213,873 of which this application is a continuation-in-part, the use of poly and/or methoxpolyethylene glycols have been shown to be of use as effective additives in water based window glass and chrome cleaner compositions. When employed in properly compounded formulations, these glycol additives have been found to provide specific advantages over competitive cleaners.

When used to clean glass or other hard, non-porous surfaces, these additives have been found to provide improved lubricity while wiping the surface during the wet to dry stage with appropriate toweling. Their use has also been found to provide a marked improvement in the transferral of oil and grease surface contamination to the toweling. In addition, the extremely thin transparent residual film or coating left on the surface has been found to repel effectively, for long periods of time, airborne organic contaminants. For example, inside windows of automobiles can be kept visually clear of oil and plasticizer fumes, using the formulations containing the poly or methoxypolyethylene glycols, for very long time periods as compared to conventional cleaners.

My copending application covered the use of polyethylene glycol and/or methoxypolyethylene glycol additives in the molecular weight range of about 400 to 20,000. The lower molecular weight materials are heavy liquids while the more preferred molecular weight additives of about 2000 and higher are wax like materials at room temperatures.

Polyethylene glycol can be expressed using the chemical formula:

$$HOCH_2(CH_2OCH_2)_nCH_2OH$$

For further clarification, a polyethylene glycol having a molecular weight of abot 20,000, the value of "n" in the above formula would be about 453. For a molecular weight of about 6000 "n" would equal about 135 and a molecular weight of about 400 would mean an "n" value of about 8.

Methoxypolyethylene glycol can be expressed using a similar formula but with the two $HOCH_2$ end groups replaced with $H_3CO$ groups as follows:

$$H_3CO(CH_2OCH_2)_nOCH_3$$

Polyethylene glycols and methoxypolyethylene glycols are the only two such categories of materials being commercially produced at this time in the United States and were the two variations evaluated in the prior application.

It will be readily apparent to organic chemists, and others skilled in the art, that alkyl derivatives of polyethylene glycol, in addition to the methylpolyethylene glycol can be prepared, and that these would also be expected to perform in a similar fashion in these liquid cleaner formulations. Such alkyl derivatives would include: ethoxy, butoxy, pentoxy, and the like. These would have related chemical formulas to that of the methoxypolyethylene glycol except for the appropriate change in the two end groups.

The long chain central $(CH_2OCH_2)_n$ structure common to all these poly or alkoxypolyethylene glycol compounds is undoubtedly the major contributor to their excellent lubricating and oil and grease repelling properties when incorporated in the cleaner compositions. Changing the end alkyl groups from one to another would be expected to have little operational effect.

It is my present purpose to show that my invention in addition to covering the use of polyethylene glycols and the single alkyl derivative of methoxypolyethylene glycols includes the use of alkyl derivatives of polyethylene glycol and teaches the use of the more general designation of polyethylene glycols and their alkyl derivatives (or alkoxypolyethylene glycols). For this reason, a sample of butoxypolyethylene glycol was prepared for evaluation. This was made in the University of Colorado, Colorado Springs, Colo., using a conventional substitution method and was accomplished as follows, starting with a 4000 molecular weight polyethylene glycol:

Polyethylene glycol was converted to the disodium salt using metallic sodium.

Reaction with 1-brombutane affored the butoxypolyethylene groups as shown below:

$$CH_3CH_2CH_2CH_2Br + NaOCH_2(CH_2OCH_2)_nCH_2ONa \rightarrow CH_3CH_2CH_2CH_2OCH_2(CH_2OCH_2)_nCH_2OCH_2CH_2CH_2CH_3 + 2NaBr$$

The resulting butoxypolyethylene glycol compound was crystallized and analyzed by 100 MHz fourier transform high resolution proton NMR spectroscopy and the existence of the terminal butyl groups verified. A control sample of the commercially obtained methoxypolyethylene glycol having a molecular weight of 2000 was similarly verified as being the methoxy compound.

As would be expected, the butoxypolyethylene glycol, prepared from the 4000 molecular weight polyethylene glycol was amost identical to the latter in physical properties, both being hard wax like solids at room temperature as well as being easily dissolved in water.

Comparison tests were then made to determine if any difference could be seen between the use of polyethylene glycol, methoxypolyethylene glycol and the butoxypolyethylene glycol. Test procedures were the same as those used in the copening application and were run using plate glass. Table XXVIII shows the specific cleaner formulations used and the results obtained. The data shows no discernable difference between the three formulations as far as lubricity, residual contamination and oil removal is concerned. These three formulations were subsequently used to clean naturally contaminated windows and again no difference in cleaning properties were noticed. All three formulations performed equally well with the overall conclusion that alkyl derivatives of polyethylene glycol can be used as effectively as polyethylene glycols and that the invention need not be limited to the use of the methoxypolyethylene glycol alone.

heavy layer of the liquid cleaner is left to dry without wiping, the residual glycol layer that remains is often hard to remove without re-wetting with a damp towel.

The substitution of triethylene glycol for the considerably lower vapor pressure and higher molecular weight poly and alkoxypolyethylene glycols in otherwise similar cleaner formulations has been found to solve this misuse problem effectively. Repeated tests have shown that the triethylene glycol will evaporate rapidly following the wiping off of the cleaner solution with the toweling. Even heavy residual amounts of the cleaner inadvertently left on a glass surface will soon vaporize, leaving no trace of the glycol.

While the long term recontamination prevention properties are sacrificed by the fairly rapidly evaporating triethylene glycol, its use may be warranted and beneficial in cleaner compositions where reasonable care in its application may be expected to be lacking.

Triethylene glycol can be expressed using the chemical formula $HOCH_2(CH_2OCH_2)_2CH_2OH$ and will be seen to be in reality a shorter molecular length form of polyethylene glycol. It has a molecular weight of 150, a vapor pressure of less than 0.01 mm at 20 C and a boiling point of 287.4 C. In addition, triethylene glycol has low toxicity, making it an excellent choice for a product

TABLE XXVIII

COMPARISON TESTS BETWEEN POLY, METHOXY AND BUTOXY POLYETHYLENE GLYCOLS OF SIMILAR MOLECULAR WEIGHT

Basic Formulation: 86.75 g $H_2O$; 9.49 g isopropanol; 0.245 g n-propanol; —g glycol-see below; 0.026 g 2,3-butanediol; 0.08 g $NH_4HCO_3$; 0.1 g $Na_3PO_4 \cdot 12H_2O$; 0.156g $NH_4OH$[4](P); 0.012g Surfactant BX-78[c]

Test Surface: 24" × 18" Plate Glass

| # | Glycol | Amount (Grams) | Glycol Mol. Wt. | Lubricity Wet to Nearly Dry Stage | Lubricity Dry Stage | Residual Contamination (Clean Glass) | Oil Removal Test (1 Drop WESSON OIL) |
|---|---|---|---|---|---|---|---|
| NJ-1 | Polyethylene Glycol PEG-4000[e] | 0.176 | ~4000 | very low drag | very low drag | none | exceptionally clean, no oil streaks remaining |
| NJ-2 | Methoxy Polyethylene Glycol MPEG-5K[f] | 0.2 | ~5000 | ~NJ-1 | ~NJ-1 | none | ~NJ-1 |
| NJ-3 | Butoxy Polyethylene Glycol | 0.21 | ~4000 | ~NJ-1 and NJ-2 no noticeable difference in repeated tests | ~NJ-1 and NJ-2 no noticeable difference in repeated tests | none | ~NJ-1 and NJ-2 no noticeable difference in repeated tests |

*FOR NOTES SEE TABLES I and XVIII

Another important development relating to my copening application, Ser. No. 885,311 for water based window, glass and chrome cleaner composition has been made. This involves the use of triethylene glycol in place of the considerably higher molecular weight poly or methoxypolyethylene glycols of the prior work.

As described earlier, the poly or alkoxypolyethylene glycols, when employed in the cleaner formulation, leave a long lasting and normally transparent coating on glass and other surfaces following their proper application. This thin residual coating is extremely helpful in preventing subsequent airborne hydrocarbon contamination for long periods of time.

The cleaner formulations of the type using poly or alkoxypolyethylene glycols can be improperly used, however, so that an occasional cloudy or steaked area may result. Such misuse occurs, or at least becomes noticeable principally when cleaning glass windows, doors or mirrors with particularly large surface areas, and results from failure of the user to wipe off a portion of the sprayed on liquid with the toweling. When a of this type.

Many other organic compounds have been evaluated, using optimized amounts, for possible use as more rapidly evaporating replacements for the poly or alkoxypolyethylene glycols. While some of these provided varying degrees of lubricity and oil and grease transfer properties, none approached the triethylene glycol from an overall comparison standpoint. Among the organics evaluated were:

3-methoxybutanol, 1,3-propylene glycol, diethylene glycol monobutyl ether, 1,3-butanedoil, 1,4-butanediol, 1,5-pentanediol, ethylene glycol monobutyl ether, diethylene glycol dimethyl ether, triethylene glycol dimethyl ether, ethylene glycol diacetate, diethylene glycol and tetraethylene glycol.

Aside from triethylene glycol, the only other candidates worth considering from the above group were found to be tetraethylene glycol, diethylene glycol, 1,3-propanediol and diethylene glycol monobutyl ether. Table XXIX shows differences in lubricity found between these various additives and triethylene glycol when used in an otherwise identical formulation. A formulation using 5000 molecular weight methoxypolyethylene glycol has also been included in the table for comparison purposes. The preferred amount of the particular organic additive specified for each of the formulations in the table had been previously determined as that amount which provided minimum drag during the wiping operation from the wet to dry stages with paper toweling.

ypolyethylene glycols. Such a comparison can be made in Table XXIX by referring to the formulation containing the 6000 molecular weight polyethylene glycol.

For further reasons, tetraethylene glycol has been found to be a poor choice for cleaner solutions over that of triethylene glycol. This involves its slower evaporation rate (vapor pressure >0.001 mm at 20° C. and boiling point of 287.2° C.) which results in a residual glycol film remaining on the glass or other surface for considerably longer time periods than required. This is especially true when, through misuse, areas may not be completely wiped free of the cleaning solution. Combi-

TABLE XXI

COMPARISON TESTS BETWEEN FORMULATIONS CONTAINING TRIETHYLENE GLYCOL AND OTHER SELECTED ORGANICS

Basic Formulation: 90.8 g $H_2O$; 2.35g isopropanol; 4.05g 1-propanol; —g organic - see below; 0.364g $NH_4OH^{(p)}$; 0.011g Surfactant BA-77$^{(b)}$ Test Surface: 24" × 18" Plate Glass

| # | Organic Additive | Amount (Grams) | Lubricity Wet to Nearly Dry Stage | Lubricity Dry Stage | Residual Contamination (Clean Glass) |
|---|---|---|---|---|---|
| IA-5 | Triethylene Glycol | 0.158 | Low Drag | Low Drag | none |
| IB-5 | Tetraethylene Glycol | 0.163 | Slightly more drag than IA-5 | Slightly more drag than IA-5 | none |
| IC-10 | Diethylene Glycol | 0.27 | Very nearly same drag as IA-5 | Considerably more drag than IA-5. Towel grabs glass surface | none |
| ID-4 | Diethylene Glycol Monobutyl Ether | 0.087 | Noticeably more drag than IA-5 | Noticeably more drag than IA-5 | none |
| IE-7 | 1,3-propanediol | 0.242 | Same or slightly less drag than IA-5 | Considerably more drag than IA-5. Towel grabs glass like ID-10 | none |
| II-4 | Polyethylene Glycol PEG-6000$^{(h)}$ | 0.202 | Slightly more drag than IA-5 but a little less than IB-5 | Slightly less drag than IA-5. Definately less drag after long additional drying time | none |

FOR NOTES-SEE TABLE I

Table XXIX shows that the formulations containing diethylene glycol monobutyl ether had relatively poor drag characteristics, both during the wet to nearly dry and in the dry wiping stages. The 1,3-propanediol had low drag during the wet to nearly dry stages but then showed considerable drag when fully dry.

While the tetraethylene glycol was found to provide good lubricity throughout the entire wiping stages, it still did not provide as good overall lubricity as the triethylene glycol. In addition, tetraethylene glycol has been found to provide poorer overall lubricity than the higher (2000–20,000) molecular weight poly and alkoxnations of the tri- and tetraethylene glycol were also evaluated but no advantage in doing so could be found.

In an attempt to further optimize the overall lubricity and cleaning properties of the triethylene glycol type compositions, it was decided to use formulation KB-14 as shown in Table XXV and XXVII. This formulation was chosen because it contains additional lubricity and grease cutting aids not present in the formulations of Table XXIX. This formulation was, of course, modified by replacing the 5000 molecular weight methoxypolyethylene glycol with an appropriate amount of triethylene glycol.

TABLE XXX

VARIATIONS OF BORATE AND PHOSPHATE ADDITIVES TO TRIETHYLENE GLYCOL CONTAINING FORMULATION

Basic Formulation: 86.75 g $H_2O$; 9.45 g isopropanol; 0.245g 1-propanol; 0.158g triethylene glycol; 0.033g 2,3-butanediol; 0.08 g $NH_4HCO_3$; — g borate or phosphate-see below; 0.156g $NH_4OH^{(p)}$; 0.012g Surfactant BX-78$^{(c)}$ Test Surface: 24" × 18" Plate Glass

| # | Borate or Phosphate | Amount (Grams) | Lubricity Wet to Nearly Dry Stage | Lubricity Dry Stage |
|---|---|---|---|---|
| MD-1 | $Na_3PO_4 . 12H_2O$ | 0.1 | Excellent - very low drag | Excellent - low drag |
| MD-10 | $KBO_2 . xH_2O$ | 0.1 | ~MD-1 - very low drag | Slightly more drag than MD-1 but quite low drag |
| MD-9 | $K_2B_4O_7 . 4H_2O$ | 0.1 | Slightly more drag than MD-10 | Slightly more drag than MD-10 |
| MD-2 | $K_3PO_4 . xH_2O$ | 0.1 | Noticeably more drag than MD-1 | ~MD-1 |
| MD-3 | $Na_4P_2O_7 . 10H_2O$ | 0.1 | Considerabe drag when almost dry | Considerable drag |

TABLE XXX-continued

VARIATIONS OF BORATE AND PHOSPHATE ADDITIVES TO TRIETHYLENE GLYCOL CONTAINING FORMULATION

Basic Formulation: 86.75 g $H_2O$, 9.45 g isopropanol, 0.245g 1-propanol, 0.158g triethylene glycol, 0.033g 2,3-butanediol, 0.08 g $NH_4HCO_3$, — g borate or phosphate-see below, 0.156g $NH_4OH^{(p)}$, 0.012g Surfactant BX-78$^{(c)}$ Test Surface: 24" × 18" Plate Glass

| # | Borate or Phosphate | Amount (Grams) | Lubricity Wet to Nearly Dry Stage | Lubricity Dry Stage |
|---|---|---|---|---|
| MD-4 | $K_4P_2O_7 . 3H_2O$ | 0.1 | ~MD-3 | Slightly more drag than MD-3 |
| MD-5 | $Na_5P_3O_{10}$ | 0.1 | Noticeably more drag than MD-1 but less than MD-3 | ~MD-3 |
| MD-6 | $K_5P_3O_{10}$ | 0.1 | ~MD-4 | ~MD-4 |
| MD-7 | $(NaPO_3)_6$ | 0.1 | Noticeably more drag than MD-1 but slightly less than MD-3 | Noticeably more drag than MD-1 but slightly less than MD-3 |
| MD-8 | $Na_2B_4O_7 . 10H_2O$ | 0.1 | Noticeably more drag than MD-9 | Considerable drag ~MD-3 |

*FOR NOTES - SEE TABLE I

Tests were then made by replacing the potassium tetroborate ($K_2B_4O_7.4H_2O$) in the modified KB-14 formulation with a variety of other borates and phosphates. The results of this test are shown in Table XXX. The trisodium phosphate ($Na_3PO_4.12H_2O$) was found to be the preferred oil and grease cutting additive for these triethylene glycol containing formulations. Potassium metaborate ($KBO_2.xH_2O$) and potassium tetraborate ($K_2B_4O_7.4H_2O$) were also found to be good choices. Amounts of about 0.1 g of the phosphate or borate per 100 g of cleaner solution were used in the formulations of Table XXX but prior testing has shown that the amount used is not especially critical so long as noticeable residual deposits do not result.

Additional modifications were made in the triethylene glycol modified KB-14 formulation by replacing the 2,3-butanediol with other high boiling point organics. These included 1,3-propanediol, 3-methoxybutanol, diethylene glycol, monobutyl ether, 1,4-butanediol and 1,5-pentanediol. Amounts were adjusted for maximum lubricity properties in each instance. The 2,3-butanediol was found in these tests to provide the best overall lubricity although some of the others were found to give good results.

Table XXXI shows the effect on lubricity of varying the amount of 2,3-butanediol in a modified KB-14 type formulation containing triethylene glycol and trisodium phosphate. This data verified that the preferred amount of 2,3-butanediol was more than that required in the methoxypolyethylene glycol KB-14 formulation of the copending application.

The amount of triethylene glycol required for obtaining the highest lubricity and best overall cleaning properties had been determined earlier using formulations similar to that of IA-5 listed in Table XXIX. This determination was made again using the triethylene glycol modified KB-14 type formulation and also using the preferred 2,3-butanediol amount and the trisodium phosphate as the grease cutting additive. The results are shown in Table XXXII and indicate that the preferred amount of triethylene glycol has not changed. See formulation MB-5.

A formulation using 5000 molecular weight methoxypolyethylene glycol is also included in Table XXXII for comparison purposes—see formulation MB-7. Note that the amount of 2,3-butanediol has been increased in this one formulation to provide for maximum lubricity characteristics with a methoxypolyethylene glycol type system, in order to allow the best possible comparisons. Overall, both the triethylene glycol and methoxypolyethylene glycol formulations, MB-5 and MB-7, showed essentially equivalent lubricity and oil removal test results. In addition, Table XXXII includes a commercially available Window Glass and Chrome Cleaner, WINDEX, which shows somewhat greater overall drag properties during the wiping from wet to dry and dry stages and shows considerably more residual oil contamination in comparison to the triethylene glycol and methoxypolyethylene glycol formulations MB-5 and MB-7.

TABLE XXXI

VARIATIONS IN AMOUNT OF 2,3-BUTANEDIOL USING TRIETHYLENE GLYCOL CONTAINING FORMULATION

Basic Formulation: 86.75 g $H_2O$, 9.45 g isopropanol, 0.245g 1-propanol, 0.158g triethylene glycol, —g 2,3-butanediol - see below, 0.08g $NH_4HCO_3$, 0.1g $Na_3PO_4 . 12H_2O$, 0.156g $NH_4OH^{(p)}$, 0.012g Surfactant BX-78$^{(c)}$ Test Surface: 24" × 18" Plate Glass

| # | 2,3-Butanediol Amount (Grams) | Lubricity Wet to Nearly Dry Stage | Lubricity Dry Stage |
|---|---|---|---|
| MC-1 | 0.026 | Noticeably more drag than MC-1¼ | ~MC-1¼ |
| MC-1¼ | 0.033 | Excellent - very low drag | Excellent - low drag |
| MC-1½ | 0.039 | Low drag but slightly more than MC-1¼ | ~MC-1¼ |

TABLE XXXI-continued

VARIATIONS IN AMOUNT OF 2,3-BUTANEDIOL USING TRIETHYLENE GLYCOL CONTAINING FORMULATION

Basic Formulation: 86.75 g $H_2O$, 9.45 g isopropanol, 0.245g 1-propanol, 0.158g triethylene glycol, —g 2,3-butanediol - see below, 0.08g $NH_4HCO_3$, 0.1g $Na_3PO_4 \cdot 12H_2O$, 0.156g $NH_4OH^{(p)}$, 0.012g Surfactant BX-78$^{(c)}$ Test Surface: 24" × 18" Plate Glass

| # | 2,3-Butanediol Amount (Grams) | Lubricity Wet to Nearly Dry Stage | Lubricity Dry Stage |
|---|---|---|---|
| MC-1¾ | 0.046 | Noticeably more drag than MC-1¼ | ~MC-1¼ |
| MC-2 | 0.052 | Very noticeable drag-considerably more than MC-1¼ | ~MC-1¼ |

* FOR NOTES - SEE TABLE I

TABLE XXXII

VARIATIONS IN AMOUNTS OF TRIETHYLENE GLYCOL USING MODIFIED KB-14 FORMULATIONS

Basic Formulation: 86.75 g $H_2O$, 9.45 g isopropanol, 0.245g 1-propanol, —g glycol - see below, —g 2,3-butanediol - see below, 0.08 g $NH_4HCO_3$, 0.1 g $Na_3PO_4 \cdot 12H_2O$, 0.156g $NH_4OH^{(p)}$, 0.012g Surfactant BX-78$^{(c)}$

| # | Glycol | Amount (Grams) | 2,3-Butanediol Amt. (Grams) | Lubricity Wet to Dry Stages | Oil Removal Test (1 Drop WESSON OIL) |
|---|---|---|---|---|---|
| MB-2 | Triethylene Glycol | 0.063 | 0.033 | Very great drag-not a good formulation | Not Measured |
| MB-4 | Triethylene Glycol | 0.126 | 0.033 | Very noticeably less drag than MB-2 but very noticeably more drag than MB-5 below | Not Measured |
| MB-4½ | Triethylene Glycol | 0.142 | 0.033 | Low drag-a little more drag than MB-5 but noticeably less drag than MB-4 | Not Measured |
| MB-5 | Triethylene Glycol | 0.158 | 0.033 | Excellent-very low drag wet to nearly dry and when wiped to dry stage | No visible oil streaks |
| MB-5½ | Triethylene Glycol | 0.173 | 0.033 | Low drag-a little more drag than MB-5 but noticeably less than MB-6 below | Not Measured |
| MB-6 | Triethylene Glycol | 0.189 | 0.033 | Very Noticeably more drag than MB-5 and slightly more than MB-4 | Not Measured |
| MB-7 | Methoxy Polyethylene Glycol - MPEG-5K$^{(f)}$ | 0.2 | 0.026 | Excellent-probably very slightly more drag in nearly dry state than MB-5 but probably very slightly less drag than MB-5 when first reaching dry stage. Definitely less drag than MB-5 after extended drying time however | No visible oil streaks, ~MB-5 |
| WINDEX | | — | — | More drag definitely noticeably in wet to nearly dry and in dry wiping stages than MB-5 or MB-7 above | Many visible oil streaks over most of surface |

FOR NOTES SEE TABLE I

In summary, the triethylene glycol has been found to supply a unique set of properties not found in any other organic compound tested as a substitute for the poly or alkoxypolyethylene glycols. It has been found to be a highly effective lubricant during the wiping from the wet to nearly dry stages and evaporates just slowly enough to provide very low surface drag even when wiped to the completely dry stage. It has also been found to provide highly effective oil and grease transfer from contaminated surfaces to the toweling during use.

Tests have further shown that properly adjusted triethylene glycol containing cleaner formulations can perform equally as well as their poly or alkoxypolyethylene glycol counterparts covered in my copending application. This applies to overall lubricity and ease of use as well as oil and grease removal and general cleaning characteristics. The primary differences between the two systems are that the higher molecular weight glycols provide long term recontamination protection but can, with careless or improper use, leave visual streaking on the surface being cleaned. On the other hand, the triethylene glycol system essentially eliminates the visual residue problem because of the rapid glycol evaporation but does not, of course, provide for long term recontamination protection.

Again, all test procedures used in evaluating the triethylene glycol containing formulations covered in Tables XXIX through XXXII were the same as those employed in the copending application.

What is claimed:

1. A water based cleaning composition consisting essentially of water on the order of about 59.3 to about 99.58 weight percent, a cleaning agent selected from the group consisting of ammonium hydroxide, a monohydroxy alcohol containing not more than 3 carbon atoms and mixtures thereof on the order of about 0.31 to about 40.3 weight percent plus an amount of a lubricity compound comprised of a water soluble alkyl derivative of ethylene glycol having the formula $ROCH_2(CH_2OCH_2)_nCH_2OR$ wherein n is at least 2 and R is an on the order of about 0.025 to about 0.3 weight percent to impart substantial lubricity to the composition.

* * * * *

UNITED STATES PATENT AND TRADEMARK OFFICE

CERTIFICATE OF CORRECTION

PATENT NO. : 4,315,828

DATED : February 16, 1982

INVENTOR(S) : Peter K. Church

It is certified that error appears in the above—identified patent and that said Letters Patent is hereby corrected as shown below:

Column 60, line 4, claim 1, after the word "an" insert --alkyl radical,--.

Signed and Sealed this

*Fifteenth* Day of *June 1982*

[SEAL]

*Attest:*

GERALD J. MOSSINGHOFF

*Attesting Officer*

*Commissioner of Patents and Trademarks*